US010456935B2

(12) United States Patent
Zak et al.

(10) Patent No.: US 10,456,935 B2
(45) Date of Patent: Oct. 29, 2019

(54) SHAVING APPARATUS AND SHAVING APPARATUS HEAD

(71) Applicant: Hybrid Razor LTD, Rosh Haayin (IL)

(72) Inventors: Shoham Zak, Givat Ela (IL); Beni Nachon, Haifa (IL); Gil Perlberg, Zichron Yaakov (IL); Tsafrir Ben-Ari, Shimshit (IL)

(73) Assignee: HYBRID RAZOR LTD (IL)

( * ) Notice: Subject to any disclaimer, the term of this patent is extended or adjusted under 35 U.S.C. 154(b) by 0 days.

(21) Appl. No.: 15/418,835

(22) Filed: Jan. 30, 2017

(65) Prior Publication Data

US 2017/0136636 A1 May 18, 2017

Related U.S. Application Data

(63) Continuation-in-part of application No. 14/101,058, filed on Dec. 9, 2013, now abandoned, which is a continuation of application No. 13/228,167, filed on Sep. 8, 2011, now Pat. No. 8,601,696, which is a continuation-in-part of application No. 13/008,510, filed on Jan. 18, 2011, now Pat. No. 8,033,022.

(60) Provisional application No. 61/295,783, filed on Jan. 18, 2010, provisional application No. 62/325,166, filed on Apr. 20, 2016.

(51) Int. Cl.

| | |
|---|---|
| ***B26B 19/18*** | (2006.01) |
| ***B26B 21/34*** | (2006.01) |
| ***B26B 21/40*** | (2006.01) |

(52) U.S. Cl.

CPC ..... *B26B 19/18* (2013.01); *B26B 21/34* (2013.01); *B26B 21/4081* (2013.01)

(58) Field of Classification Search

CPC ..... B26B 19/14; B26B 19/18; B26B 19/26; B26B 19/265

USPC ..... 30/43.4–43.6

See application file for complete search history.

(56) References Cited

U.S. PATENT DOCUMENTS

| | | | | |
|---|---|---|---|---|
| D190,325 | S | 5/1877 | Hooper | |
| 911,472 | A | 2/1909 | Brunacci | |
| 1,338,305 | A | 4/1920 | Jones | |
| 1,404,603 | A * | 1/1922 | Gray | B26B 19/42 30/34.2 |
| 1,420,943 | A | 6/1922 | Howard | |

(Continued)

FOREIGN PATENT DOCUMENTS

| | | |
|---|---|---|
| JP | S4886650 | 11/1973 |
| JP | S5495383 | 7/1979 |

OTHER PUBLICATIONS

Corresponding EP Office Action for Application No. 11732717.1 dated Jun. 15, 2015. EP.

*Primary Examiner* — Jason Daniel Prone

(74) *Attorney, Agent, or Firm* — The Belles Group, P.C.

(57) ABSTRACT

A motorized shaving apparatus and head therefor that cuts or trims hair via shearing. In one embodiment, the invention is a shaving apparatus head having a body, a rotary cutter mounted to the body so as to be rotatable about a rotational axis, the rotary cutter having cutting edges that collectively define a reference cylinder about the rotational axis, and a blade mounted to the body so as to extend along a first reference plane that intersects the reference cylinder, the blade positioned so that a user's hairs are sheared between a cutting edge of the blade and the cutting edges of the rotary cutter when the rotary cutter is rotating about the rotational axis.

18 Claims, 13 Drawing Sheets

(56) References Cited

U.S. PATENT DOCUMENTS

| | | | | |
|---|---|---|---|---|
| 1,436,960 | A | 11/1922 | Jakubiec | |
| 1,981,202 | A | 11/1934 | Shipman | |
| 2,096,379 | A | 10/1937 | Peak | |
| 2,127,881 | A | 8/1938 | Leopold | |
| 2,186,092 | A | 1/1940 | Benner | |
| 2,229,971 | A | 1/1941 | Hammerling | |
| 2,229,972 | A | 1/1941 | Neil | |
| 2,281,789 | A | 5/1942 | Moskovics | |
| 2,281,922 | A | 5/1942 | Godfrey | |
| 2,342,291 | A | 2/1944 | Raffaele | |
| 2,367,686 | A | 1/1945 | Neidig | |
| 2,423,595 | A | 7/1947 | Hall | |
| 2,474,027 | A | 6/1949 | Morris | |
| 2,524,822 | A | 10/1950 | Neidig | |
| 2,594,764 | A | 4/1952 | Garrard et al. | |
| 2,601,721 | A | 7/1952 | Garrard et al. | |
| 2,803,874 | A | 8/1957 | Obolensky | |
| 2,839,829 | A | 6/1958 | Raymond | |
| 2,858,607 | A | 11/1958 | Kane | |
| 2,877,548 | A | 3/1959 | Starre | |
| 3,050,851 | A | 8/1962 | Negri | |
| 3,058,212 | A | 10/1962 | Holzmann | |
| 3,128,550 | A | 4/1964 | Miselli | |
| 3,381,373 | A | 5/1968 | Brown | |
| 3,494,031 | A | 2/1970 | Sklenar | |
| 3,710,442 | A | 1/1973 | Meyer | |
| 3,829,966 | A | 8/1974 | Owens | |
| 4,033,034 | A | 7/1977 | Imai | |
| 4,043,036 | A | 8/1977 | Stevens, Sr. et al. | |
| 4,151,645 | A | 5/1979 | Tietjens | |
| 4,688,329 | A | 8/1987 | Oord | |
| 4,802,281 | A | 2/1989 | Tietjens | |
| 4,807,359 | A | 2/1989 | Wijma | |
| 4,811,483 | A | 3/1989 | Bakker et al. | |
| 4,811,484 | A | 3/1989 | Wijma et al. | |
| 4,827,613 | A | 5/1989 | Bakker | |
| 4,884,338 | A | 12/1989 | Stewart | |
| 4,894,912 | A | 1/1990 | Tietjens | |
| 5,007,168 | A | 4/1991 | Messinger | |
| 5,022,154 | A | 6/1991 | Johnson | |
| 5,035,053 | A | 7/1991 | Hoekstra | |
| 5,313,704 | A | 5/1994 | Atsumi | |
| 5,377,699 | A | 1/1995 | Varnum | |
| 5,745,995 | A | 5/1998 | Yamashita et al. | |
| 6,442,840 | B2 | 9/2002 | Zucker | |
| 6,711,822 | B1 | 3/2004 | Ginns | |
| 7,669,336 | B2 | 3/2010 | Kawafune | |
| 7,690,117 | B2 | 4/2010 | Rogatschnig | |
| 7,900,359 | B2 | 3/2011 | Royle | |
| 8,033,022 | B2 | 10/2011 | Ben-Ari | |
| 8,061,041 | B2 | 11/2011 | Jessemey | |
| 8,601,696 | B2 | 12/2013 | Ben-Ari | |
| 8,745,876 | B2 | 6/2014 | Hage et al. | |
| 9,862,107 | B2 * | 1/2018 | Perlberg | B26B 19/18 |
| 10,195,752 | B2 * | 2/2019 | Perlberg | B26B 19/18 |
| 2005/0000093 | A1 | 1/2005 | Shagalov | |
| 2006/0218793 | A1 | 10/2006 | Zucker | |
| 2007/0220755 | A1 | 9/2007 | Dror | |
| 2008/0060202 | A1 | 3/2008 | Oh | |
| 2008/0155831 | A1 | 7/2008 | Royle et al. | |
| 2008/0216320 | A1 | 9/2008 | Royle et al. | |
| 2011/0016722 | A1 | 1/2011 | Stark | |
| 2014/0096397 | A1 * | 4/2014 | Ben-Ari | B26B 19/18 30/43.6 |
| 2016/0096279 | A1 | 4/2016 | Perlberg et al. | |
| 2017/0057103 | A1 * | 3/2017 | Perlberg | B26B 21/34 |
| 2018/0079093 | A1 * | 3/2018 | Perlberg | B26B 19/18 |
| 2019/0118396 | A1 * | 4/2019 | Zak | B26B 19/18 |

* cited by examiner

SHAVING APPARATUS AND SHAVING APPARATUS HEAD

CROSS-REFERENCE TO RELATED PATENT APPLICATIONS

The present application is a continuation-in-part of U.S. patent application Ser. No. 14/101,058, filed Dec. 9, 2013, which is a continuation of U.S. patent application Ser. No. 13/228,167, filed Sep. 8, 2011, now U.S. Pat. No. 8,601,696, which in turn is a continuation-in-part of U.S. patent application Ser. No. 13/008,510, filed Jan. 18, 2011, now U.S. Pat. No. 8,033,022, which in turn claims the benefit of U.S. Provisional Patent Application No. 61/295,783, filed Jan. 18, 2010. The present application also claims priority to U.S. Provisional Patent Application No. 62/325,166, filed on Apr. 20, 2016. The entirety of each of the above-referenced applications is hereby incorporated by reference.

FIELD OF THE INVENTION

The present invention relates generally to motorized shaving apparatus that utilize a shearing technique to cut hair bristles, and specifically to a motorized shaving apparatus that shears hairs between a rotary cutter and a fixed blade.

BACKGROUND OF THE INVENTION

The current methods for removing hair from the human body, by shaving, as opposed to epilation, involve two basic approaches: the razor approach, wherein a very sharp blade is pushed against the skin at an angle, thereby cutting hair; and the screen approach, wherein a thin fenestrated metal screen is moved across the skin, exposing hair though the holes and cutting them by a mechanized, typically motorized, cutting element.

In the sharp razor blade approach, the energy for cutting is provided by the hand driving the razor across the skin of the user, typically by the hand of the user him/herself, and the hair is cut by the impact force applied thereon and by virtue of its stiffness. The conditions of cutting hair are a compromise between the ease of cutting a soft (or softened) hair (or hair bristle) and having the necessary counter-force against the blade's impact which can only come from the hardness of the hair bristle. Apart from being a compromise difficult to optimize daily on a variety of hair bristles, the sharpness of the blade and its angle pose a constant risk of nicks and cuts, as the blade is driven forcefully across the skin.

In the screen approach of most motorized shaving apparatus, the problem of safety is mitigated since the skin and the cutting elements are separated by the screen. Moreover, the hair bristles which penetrate the screen through its holes are given a prop to be cut against; hence, the lack of a counter-force for cutting is also mitigated to some extent. However, in order to arrive at an efficient cutting condition, the hair bristle must enter a hole and be perpendicular to the skin, requirements which are not always met unless the screen is constantly moved across the skin. Still, when the hair bristle is eventually cut at the optimal angle, it cannot be cut close to the skin due to the separating screen.

One cutting technique which requires minimal force for cutting hair can be effected by scissors. Scissors cut hair at the crossing point of two blades which do not have to be very sharp in order to cut the hair due to the fact that the blades contact the hair from substantially opposite directions in the plane of cutting, mutually providing each other with a counter-force for cutting. While it is impractical to use scissors for daily shaving, which requires maximal closeness of the cutting point to the skin, the scissors cutting technique was implemented in the form of rotary cutter units cutting hair against a flat and straight stationary blade. This hair cutting technique is capable of providing a very close shave since the cutting blades are positioned flush against the skin at the time of cutting. This also renders this cutting approach relatively safe from accidental cuts.

However, the presently known configurations which have attempted to implement this technique have suffered, among other drawbacks, from improperly positioned driving mechanisms, which were placed outside of the shaving head, moving the rotary cutter unit by means of a direct shaft, or indirectly by means of external gears, bevel gears, worm gears, sprockets, belt and pulley mechanisms and the like. Essentially, these external driving mechanisms suffer from loss of kinetic energy, leading to limited rotation speed of the rotary cutter unit, and therefore provide poor shaving results. Moreover, all these external driving mechanisms lead to cumbersome designs, large size and substantial weight of the resulting shaving device since they house the drive mechanism alongside or perpendicularly to the shaving head. In addition, they require large powerful motors with or without portable power sources.

For example, one rotary razor exists that comprises a casing provided with a slot, a cutting edge formed along one edge of the slot, guards projecting from the opposite side of the slot to a point immediately adjacent the cutting edge, the cutting edge and the guards being rigid with respect to the casing, and a rotary cutter within the casing arranged to co-act with such cutting edge. The rotary cutter in this rotary razor is provided with an adjustment means whereby it may be set at a point in close proximity to the first named cutting edge but not in frictional contact therewith, such means comprising bearings within the casing. The bearings each have a pair of projecting arms and the casing is provided with a slot adjacent each arm. Set screws project through the slots and into the arms while another arm projects from each pair of arms at right angles thereto. The set screws project through the casing and into the last named arms. This rotary razor provides a rotary cutter shaving device wherein the rotary cutter unit is pressed and held against the stationary blade in order to affect a close and effective shave. However, in this rotary razor, the drive mechanism is not part of the shaving head or hair-cutting head.

A shearing tool also exists with a tapered cylindrical cutter held by bearings inside a housing. The housing is formed with a slot, wherein one of the edges of the slot constitutes a cutting edge cooperating with the cutting edges of the tapered cylindrical cutter. In this shearing tool, a shaft extends out of the hair-cutting head and the drive mechanism is not part of the hair-cutting head.

Another rotary razor exists having a casing formed with a longitudinal slot, a rotary shaft, a series of filler blocks encircling the shaft, a series of razor blades engaged between the filler blocks and having their edges projecting spirally beyond the outer face of the filler blocks. Upon rotation of the shaft, the razor blades pass across the slot opening of the casing. A plate on the casing is arranged along one edge of the slot in a position to contact the cutting edge of the spirally positioned blades on the shaft. While this rotary razor provides a solution to the production of the rotary cutter unit, the drive mechanism is outside the hair-cutting head.

Another shaver exists comprising a tubular casing formed with a longitudinally extending slot and with comb teeth or fingers extending transversely to the slot. A rotor is locate within and extends longitudinally in the casing, and is rotatable therein. The rotor is formed with radial ridges extending helically and longitudinally of the rotor and have edge faces confronting the annular wall of the casing. The blades have their outer surfaces contacting the inner surface of the annular wall of the casing and are thereby pressed inwardly and cut hair against the comb's teeth. This shaver has a motor casing of usual construction, serving as a handle, and positioned outside of the hair-cutting head.

Still another rotary safety razor exists comprising a shaving head having a rotary cutter unit (with helical blades) mounted to rotate about an axis. The head of this rotary safety razor comprises, in combination, a tubular casing adapted to contain the cutter and split along a longitudinal line so as to present a slot with two edges. One of these edges is formed along a major portion of its length with the cutting edge of a stationary straight blade while the other of these edges is formed with a comb opposite the cutting edge. This rotary safety razor addresses the issue of the drive mechanism by placing it outside the shaving head and transferring the rotational motion of the external motor via a shaft formed at one end with a worm engaging worm teeth on a rotatable cutter unit.

Additional motorized shaving apparatus exist that utilize a screen wherein the cutting elements do not come in direct contact with the skin but rather are located behind the screen.

BRIEF SUMMARY OF THE INVENTION

The invention is directed to a shaving apparatus and head therefor that operates via shearing of a user's hair between a fixed blade and a rotary cutter having cutting edges thereon.

In one embodiment, the invention can be a shaving apparatus comprising: a handle; a head having a working surface, the working surface comprising a fixed blade that extends along a first reference plane; a rotary cutter disposed within the head, the rotary cutter comprising cutting edges that collectively define a reference cylinder, wherein the first reference plane of the fixed blade intersects the reference cylinder; a power source; a motor operably coupled to the power source and the rotary cutter to rotate the rotary cutter about a rotational axis; and wherein the cutting edges of the rotary cutter are positioned adjacent a cutting edge of the fixed blade so that a user's hairs are sheared between the cutting edge of the fixed blade and the cutting edges of the rotary cutter when the rotary cutter is rotating.

In another embodiment, the invention can be a shaving apparatus head comprising: a body; a rotary cutter mounted to the body so as to be rotatable about a rotational axis, the rotary cutter comprising cutting edges that collectively define a reference cylinder about the rotational axis; and a blade mounted to the body so as to extend along a first reference plane that intersects the reference cylinder, the blade positioned so that a user's hairs are sheared between a cutting edge of the blade and the cutting edges of the rotary cutter when the rotary cutter is rotating about the rotational axis.

In yet another embodiment, the invention can be a shaving apparatus comprising: a handle; a head having a working surface, the working surface comprising a fixed blade having an exposed top surface and an opposite bottom surface; a rotary cutter disposed within the head, the rotary cutter comprising cutting edges that collectively define a reference cylinder, the reference cylinder protruding above the exposed top surface of the fixed blade; a power source; a motor operably coupled to the power source and the rotary cutter to rotate the rotary cutter about a rotational axis; and wherein the cutting edges of the rotary cutter are positioned adjacent a cutting edge of the fixed blade so that a user's hairs are sheared between the cutting edge of the fixed blade and the cutting edges of the rotary cutter when the rotary cutter is rotating.

In still another embodiment, the invention can be a shaving apparatus head comprising: a body; a blade mounted to the body, the blade having an exposed top surface and an opposite bottom surface; a rotary cutter mounted to the body so as to be rotatable about a rotational axis, the rotary cutter comprising cutting edges that collectively define a reference cylinder about the rotational axis, the reference cylinder protruding above the exposed top surface of the blade; and wherein the cutting edges of the rotary cutter are positioned adjacent a cutting edge of the blade so that a user's hairs are sheared between the cutting edge of the blade and the cutting edges of the rotary cutter when the rotary cutter is rotating about the rotational axis.

In a further embodiment, the invention can be a shaving apparatus comprising: a handle; a head having a working surface, the working surface comprising a fixed blade that extends along a reference plane; a rotary cutter disposed within the head, the rotary cutter comprising cutting edges that collectively define a reference cylinder; wherein a first portion of the reference cylinder is located on a first side of the reference plane and a second portion of the reference cylinder is located on a second side of the reference plane; a power source; a motor operably coupled to the power source and the rotary cutter to rotate the rotary cutter about a rotational axis; and wherein the cutting edges of the rotary cutter are positioned adjacent a cutting edge of the fixed blade so that a user's hairs are sheared between the cutting edge of the fixed blade and the cutting edges of the rotary cutter when the rotary cutter is rotating.

In a still further embodiment, the invention can be a shaving apparatus head comprising: a body; a rotary cutter mounted to the body so as to be rotatable about a rotational axis, the rotary cutter comprising cutting edges that collectively define a reference cylinder about the rotational axis; a blade mounted to the body so as to extend along a reference plane, wherein a first portion of the reference cylinder is located on a first side of the reference plane and a second portion of the reference cylinder is located on a second side of the reference plane; and wherein the cutting edges of the rotary cutter are positioned adjacent a cutting edge of the blade so that a user's hairs are sheared between the cutting edge of the blade and the cutting edges of the rotary cutter when the rotary cutter is rotating.

In another embodiment, the invention can be a shaving apparatus comprising: a handle; a head coupled to the handle and having a working surface, the working surface comprising a fixed blade having a cutting edge; a power source; a rotary cutter having cutting edges disposed within the head, the cutting edges of the rotary cutter positioned adjacent the cutting edge of the fixed blade so that a user's hairs are sheared between the cutting edge of the fixed blade and the cutting edges of the rotary cutter when the rotary cutter is rotating; a motor operably coupled to the power source and the rotary cutter to rotate the rotary cutter about a rotational axis; and wherein the rotary cutter has a tangential velocity Vt greater than 300 mm/sec.

In a further embodiment, the invention can be a shaving apparatus comprising: a handle; a head coupled to the handle and having a working surface, the working surface comprising a fixed blade having a cutting edge; a power source; a rotary cutter having cutting edges disposed within the head, the cutting edges collectively defining a reference cylinder having a radius r, the cutting edges of the rotary cutter positioned adjacent the cutting edge of the fixed blade so that a user's hairs are sheared between the cutting edge of the fixed blade and the cutting edges of the rotary cutter when the rotary cutter is rotating; a motor operably coupled to the power source and the rotary cutter to rotate the rotary cutter about a rotational axis; and wherein a number of revolutions of the rotary cutter per minute RPM is determined by the following formula: $RPM \geq 12000/(2*\Pi*r)$.

In a still further embodiment, the invention can be a method of shaving comprising: providing a shaving apparatus comprising: a power source; a head having a working surface comprising a fixed blade having a cutting edge; a rotary cutter having cutting edges disposed within the head; and a motor operably coupled to the power source and the rotary cutter to rotate the rotary cutter about a rotational axis at a tangential velocity; positioning the working surface of the head against a surface to be shaved; moving the working surface of the head along the surface to be shaved at a linear velocity; and wherein the tangential velocity of the rotary cutter is greater than the linear velocity at which the working surface is moved along the surface to be shaved.

Further areas of applicability of the present invention will become apparent from the detailed description provided hereinafter. It should be understood that the detailed description and specific examples, while indicating some embodiments of the invention, are intended for purposes of illustration only and are not intended to limit the scope of the invention.

BRIEF DESCRIPTION OF THE DRAWINGS

The features of the exemplified embodiments will be described with reference to the following drawings in which like elements are labeled similarly. The present invention will become more fully understood from the detailed description and the accompanying drawings, wherein.

DETAILED DESCRIPTION OF THE INVENTION

Figure 1:
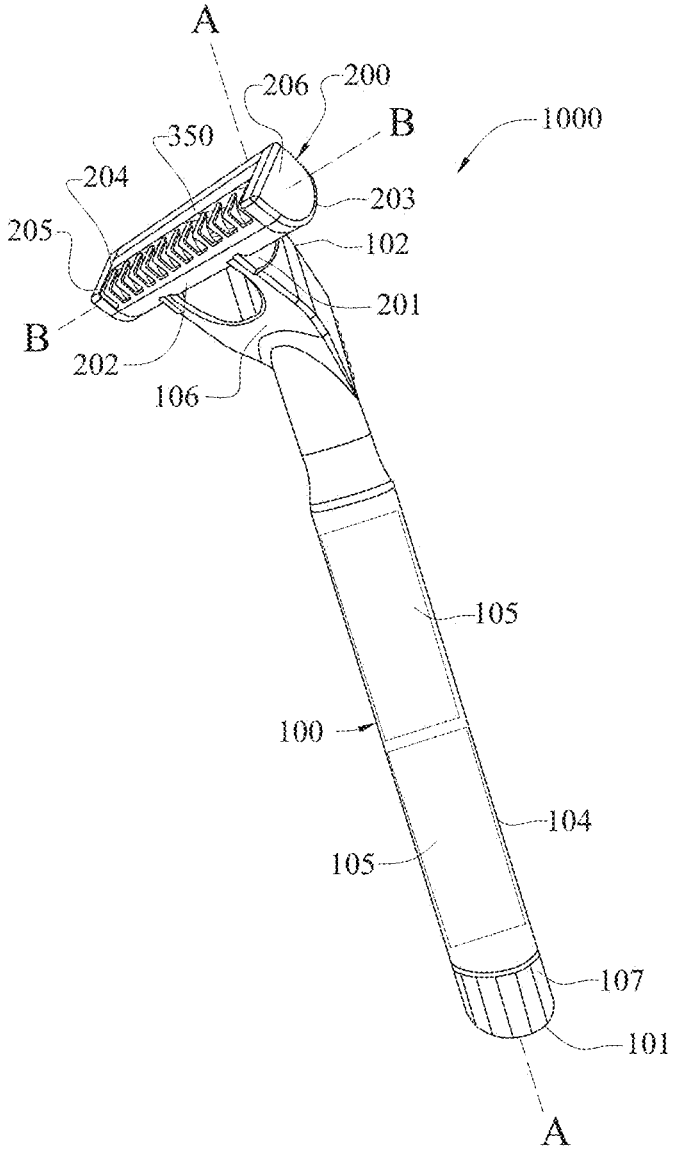
FIG. 1 is a front perspective view of a shaving apparatus according to an embodiment of the present invention.

The following description of some embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As discussed hereinabove, shaving aims to achieve safe hair cutting as close as possible to the level of the skin. In the context of human grooming activity, shaving is performed using two basic paradigms, cutting the hair bristle by a single sharp element impacting the hair from one side (e.g., razor), which can be referred to as "scraping," or by two cutting elements snipping the hair from two opposite sides (e.g. scissors and shaving machines), which can be referred to as "shearing," "clipping" or "snipping." In terms of industrial applications, these two paradigms have split early on and evolved separately.

Attempts at mechanizing the razor have resulted in two basic types of motorized razors, the vibrating razor which is directed at affording a sawing motion perpendicular to the movement of the blade across the skin, and the rotating blade, directed at mechanizing and speeding-up the scraping action. Nevertheless, shaving by the scraping paradigm has always presented a peril, either from scratching and lacerating the skin by blunt and/or rough (used) blades, or from nicks and cuts from very sharp and even fresh (unused) blades.

Compared to scraping (razor) shaving, using scissors for shaving (shearing) presents an entirely different set of problems to be solved. One problem associated with using scissors for close and safe facial shaving is the point of shear, namely the hair is less likely to be snipped at the level of the skin, leaving a substantial bristle. Another problem is speed, since a hair is cut only at the crossing of the blade-pair, an event that is less frequent when compared to the frequency of hair-blade encounters in the case of the single scraping blade (razor).

Screen-based shaving machines mitigated some of the problems of shaving by shearing, mainly closeness and speed. Still, the need for a narrow shaving head which can be placed or passed across the human face without obstructions posed a limit on the size of the shaving head to be narrow and slim, and the need for a powerful motor (and thus a large enough power supply unit) imposed limits to the size of the contemporary shaving machine from the other side of the range. Hence, a shaving machine having the requirements of a small and accessible shaving head and sufficiently powered motor is typically bulky.

While searching for an optimal solution to all the aforementioned problems associated with a mechanized scissors action shaving (shearing) apparatus, the present inventor has now accomplished a light-weigh and compact shearing shaving apparatus which provides a fast, safe and close shave.

Hence, according to some embodiments of the present invention, the problem of an accessible shaving head is solved with a narrow and slim shaving head having the moving parts confined within the rotary cutter. Furthermore, according to some embodiments of the present invention, the compact drive mechanism, which can be in the form of an electric motor, can be powered effectively using a relatively compact power source placed in a narrow tube-like handle. Because the shaving apparatus will not have external gears, shafts or belts in some embodiments, far less energy is wasted on eccentric moving parts and friction. Put together, the provisions of the present invention solve the problem of cumbersome motorized shaving apparatus by using a shaving head as described hereinbelow, which is implemented in a shaving apparatus that has, for example, the size and shape of a contemporary non-motorized razor as described below.

Figure 2:
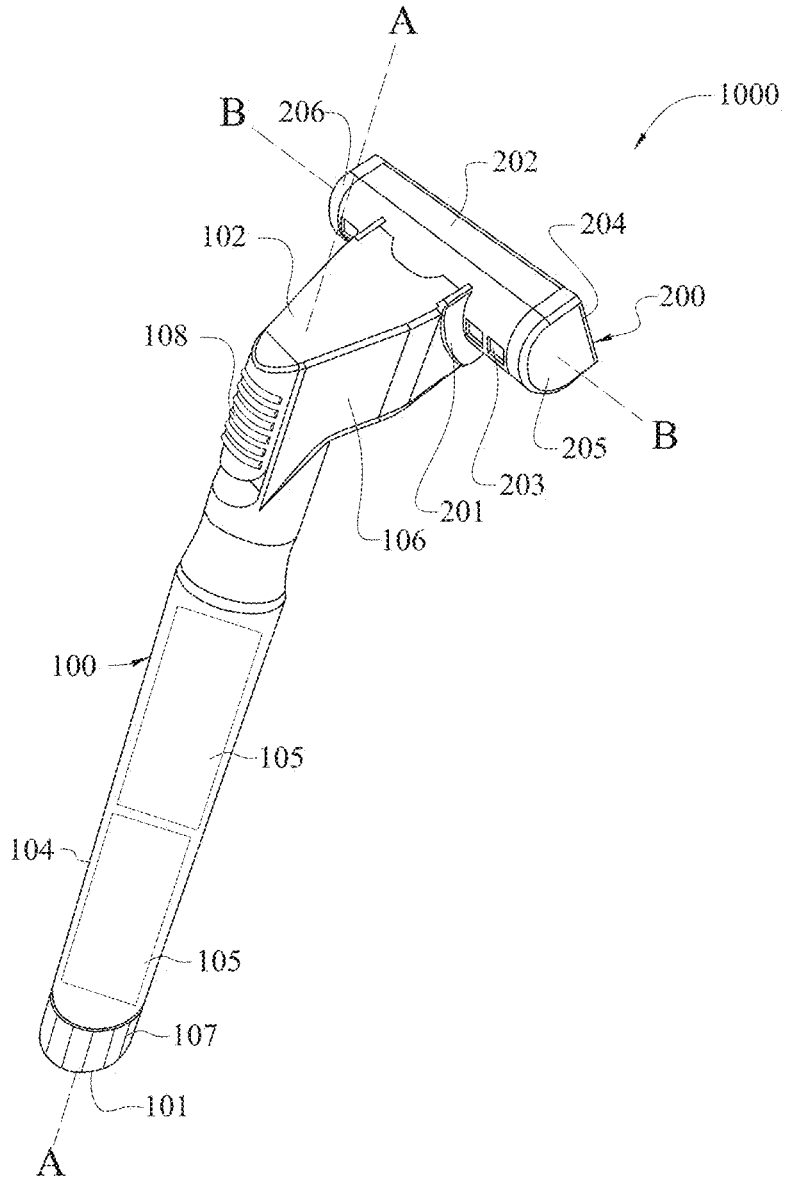
FIG. 2 is a rear perspective view of the shaving apparatus of FIG. 1.

Referring first to FIGS. 1 and 2 concurrently, a shaving apparatus 1000 according to an embodiment of the present invention is illustrated. The shaving apparatus 1000 generally comprises a handle portion 100 (hereinafter referred to as the "handle") and a head portion 200 (hereinafter referred to as the "head"). The handle 100 provides the user of the shaving apparatus 1000 with the necessary structure to comfortably and firmly grip and maneuver the shaving apparatus 1000 in the manner necessary to shave a desired area of skin. In the exemplified embodiment, the handle 100 is an elongated structure that comprises a generally cylindrical portion 104 for gripping and a mounting member 106 for coupling of the head 200 to the handle 100. In one embodiment, the handle 100 has a length between 70 mm to 140 mm.

The cylindrical portion 104 extends along the longitudinal axis A-A. In one embodiment, the cylindrical portion 104 of the handle 100 has a diameter of between 10 mm to 25 mm. The mounting member 106 is coupled to a distal end 102 of the cylindrical portion 104 and extends radially away from the longitudinal axis A-A in an inclined manner. The distal end of the mounting member 106 is configured so that the head 200 can be coupled thereto. The head 200 can be coupled to the mounting member 106 in a permanent, semi-permanent, or detachable manner. For example, the head 200 could be integrally formed with the mounting member 106, thereby creating a permanent coupling. Alternatively, the head 200 could be coupled to the mounting member 106 via ultrasonic welding, thermal welding, soldering, adhesion or combinations thereof, thereby creating a semi-permanent coupling. In still other embodiments, the head 200 could be coupled to the mounting member 106 via a snap-fit connection, a mechanical interlock, an interference fit, a threaded connection, a tab/slot interlock, a latch, or combinations thereof, thereby creating a detachable coupling. Of course, other connection techniques are contemplated and are considered to be within the scope of the invention. Moreover, in certain other embodiments of the invention, the mounting member 106 can be less prominent or omitted all together so that the head 200 is directly coupled to the cylindrical portion 104.

As will be appreciated by the skilled artisan, an attempt to arrive at a minimal size and weight of a battery-powered motorized shaving apparatus may end at the size limitation of the battery which can power the motor effectively so as to deliver the required effect for the required time period. When achieving a reduction of the work-load of the motorized element and making its action more efficient, one can then reduce the overall size limitations imposed also of the power source, namely the battery or batteries. As presented hereinbelow, the shaving head according to some embodiments of the present invention is designed such that its scissors-like shaving action can be effected by a small motor, which can therefore be powered by a correspondingly small power source, compared to presently known configurations. Hence, the shaving head design, according to embodiments of the present invention, can afford a significant reduction of power consumption, leading to a significant reduction in size of the motor assembly, leading in turn to a significant reduction in size and weight of the entire shaving apparatus.

In the exemplified embodiment, the handle 100 also acts as a water-tight housing for a power source 105 (shown in dotted lines) that powers the motor 400 that rotates the rotary cutter 300 of the head 200 (the details of which will be discussed in greater detail below with respect to FIG. 6). Of course, in other embodiments, the power source 105 may be housed elsewhere in the shaving apparatus 1000. For example, in certain alternate embodiments, the power source 105 may be housed entirely or at least partially within the head 200. The power source 105 can be in the form of one or more batteries as is known in the art. In the exemplified embodiment, the batteries are disposed on and extend along the longitudinal axis A-A of the handle 100. Of course, alternative types of power sources can be utilized to power the motor 400 as desired. The exact type of power source 105 utilized in the shaving apparatus 1000 will depend on the power requirements of the motor 400 and, thus, is not to be considered limiting of the present invention unless specifically stated otherwise in the claims.

The power source 105 could be replaceable or permanent. In embodiments in which a removable power source 105 is used, the power source 105 may be one or more batteries that could be removed from the handle 100 for replacement or recharging. In such an embodiment, the handle 100 will further comprise the necessary structure to access the chamber of the handle 100 in which the power source 105 is located. In the exemplified embodiment, a removable cap 107 is provided at the proximal end 101 of the handle 100. The removable cap 107 can be coupled to the cylindrical portion 104 of the handle 100 via a threaded connection, a tight-fit assembly, or other connection technique that would create a fluid tight boundary so that water could not enter the chamber in which the power source 105 is located. In alternate embodiments, access to the internal chamber of the handle 100 in which the power source 105 is disposed can be accomplished via a hinged panel, a latch, a removable panel or any other structure as would be known to one of skill in the art.

In embodiments where a permanent (or non-removable) battery is used, the handle 100 may further comprise an electrical port to which a power cord could be electrically coupled to recharge the power source 105. To prevent water or other fluids from entering the electrical port, the electrical port may be provided behind a removable access panel or be provided with a cap/plug that seals the electrical port.

A switch 108 is provided on the handle 100 for manually controlling the energization of the motor 400. While the switch 108 is exemplified as a manual slide switch, the switch could be any type of manual or automatic switch as would be known by those of skill in the art. In addition to the switch 108, control circuitry for controlling the performance characteristics of the motor 400 may also be located within the chamber of the handle 100 as desired.

As mentioned above, the head 200 is coupled to the distal end of the mounting member 106 of the handle 100. The head 200 has a generally elongated shape and extends along the longitudinal axis B-B. As discussed in detail below, the longitudinal axis B-B of the head 200 also serves as the axis of rotation of the rotary cutter 300. In the exemplified embodiment, when the head 200 is coupled to the handle 100, the head 200 is substantially perpendicular to the handle 100. More specifically, when the head 200 is coupled to the handle 100, the longitudinal axis B-B of the head 200 is substantially perpendicular to the longitudinal axis A-A of the handle 100. Moreover, the handle 200 is coupled to the center of the head 200 so that the shaving apparatus 1000 has a generally T-shape.

In the exemplified embodiment, the head 200 is fixedly coupled to the handle 100 through the use of fastener elements 201 that extend from a tubular housing 202 of the head 200. The fastener elements 201 are plates that extend from a rear face 203 of the head 200 opposite the front face 204 of the head 200, wherein the front face 204 can be considered the working/cutting face of the head 200 as described below. The fastener elements 201 matingly engage corresponding structure on the mounting member 106 of the handle 100. Of course, the fastener elements 201 can take on a wide variety of structures, including pins, tangs, sockets, or other coupling or mating structures.

While the head 200 is fixedly coupled to the handle 100 in the exemplified embodiment, the head 200 may be pivotally connected to the handle 100 so that the orientation of the head 200 can be pivoted with respect to the handle 100. Thought of another way, in such an arrangement, the head 200 can be pivoted so that the longitudinal axis B-B of the head 200 can be rotated relative to the longitudinal axis A-A of the handle 100. Such pivotal movement can be accomplished in a variety of manners. In one embodiment, the fastener elements 201 of the head 200 pivotally couples the head 200 to the mounting member 106. In another embodiment, the mounting member 106 is pivotally coupled to the cylindrical portion 104 of the handle 100. Pivotally coupling the head 200 to the handle 100 enables the front face 204 of the head 200 to be pivoted to any desired position with respect to the handle 100 during use of the shaving apparatus 1000, thereby allowing the user a greater degree of flexibility and the ability to shave complex contours and/or hard to reach places.

The pivotal coupling of the head 200 to the handle 100 allows the head 200 to swivel (i.e., rock) within a limited angle range about the longitudinal axis A-A of the handle. Such pivotal rotation allows the head 200 to adjust its position relative to the plane of motion and the skin of a user during use of the shaving apparatus 1000. Such pivotal motion can be limited, by mechanical means in the attachment mechanism and/or the handle 100 and/or the head 200, to a desired angle of rotation. In certain embodiments, the angle of rotation may be 180 degrees, 90 degrees, 60 degrees, 30 degrees or less than 30 degrees.

As mentioned above, in certain alternate embodiments, the head 200 will be detachably coupled to the handle 100. In such embodiments, the head 200 can be sold as a "refill" head for the handle 100. As discussed below with respect to FIG. 6, the motor 400 is located within the rotary cutter 300 of the head 200. Moreover, as discussed above, the power source 105 is located within the handle 100. Thus, a continuous electrical connection extends from the power source 105 in the handle 100 to the motor 400 in the head 200 in order to power the motor 400 during use. Therefore, in embodiments where the head 200 is detachably coupled to the handle 100, electrical interface connectors (i.e., contacts) will be provided at appropriate positions on both the handle 100 and the head 200 that come into electrical coupling with one another when the head 200 is coupled to the handle 100, thereby completing the electrical circuit.

Figure 3:
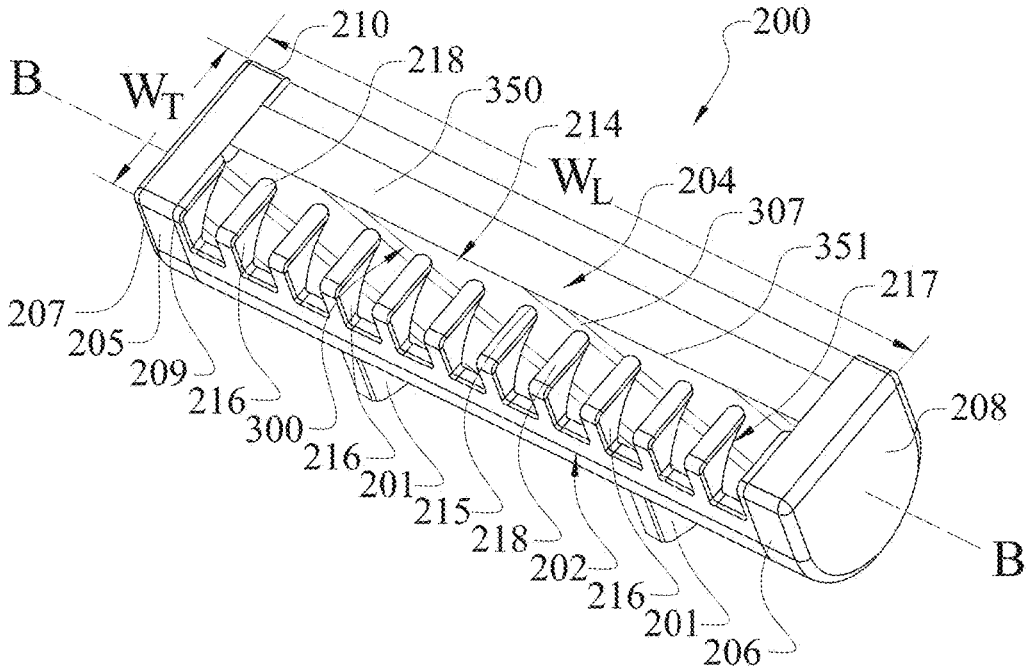
FIG. 3 is a top perspective view of a shaving apparatus head according to one embodiment of the present invention.
Figure 4:
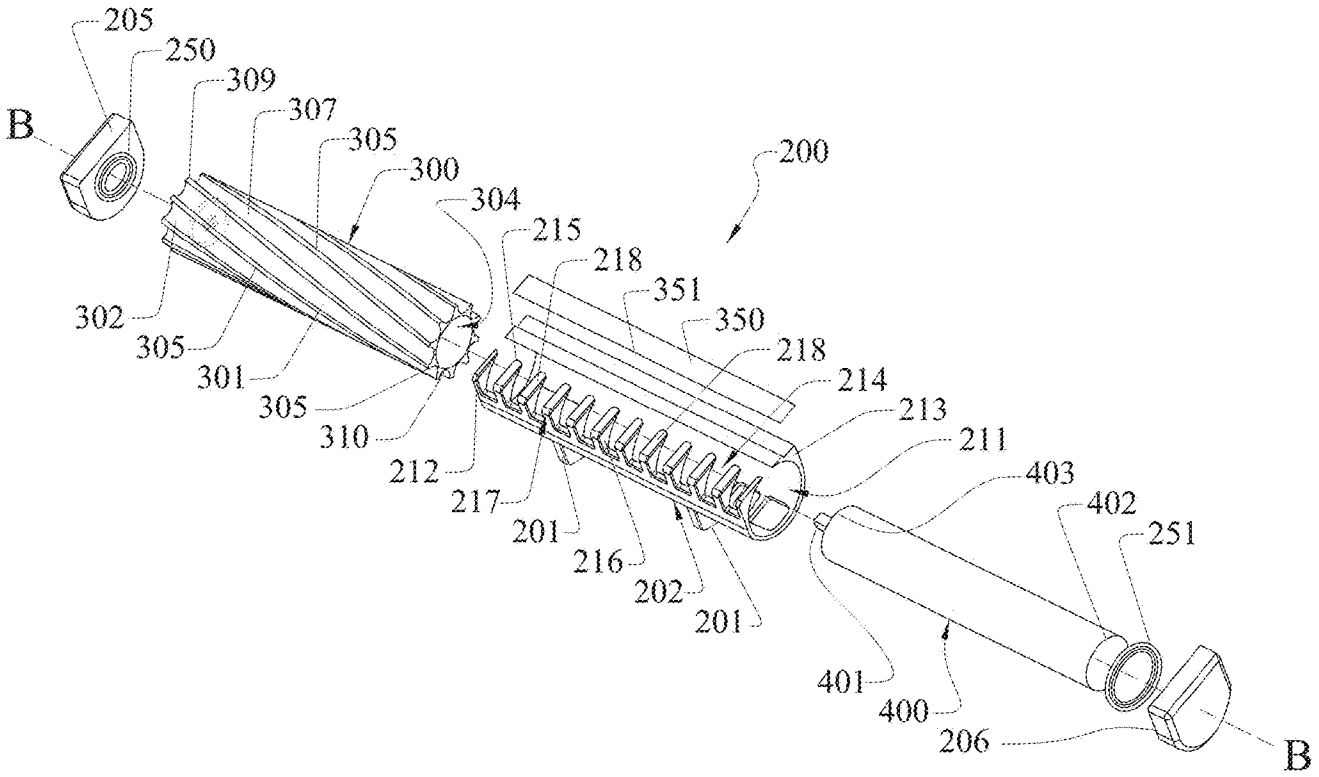
FIG. 4 is an exploded view of the shaving apparatus head of FIG. 3.

Referring now to FIGS. 3-4 concurrently, the head 200 generally comprises a tubular housing 202, a first end cap 205, a second end cap 206, a fixed blade 350, the motor 400, the rotary cutter 300, a first annular bearing 250, and a second annular bearing 251. When the head is assembled (discussed below with respect to FIG. 6), as shown in FIG. 3, the head 200 is a compact, elongated and generally cylindrical structure, extending along longitudinal axis B-B.

The head 100 extends from a first end 207 to a second end 208 along the longitudinal axis B-B, thereby defining a maximum longitudinal width $W_L$ of the head 200. In an exemplary embodiment, the maximum longitudinal width $W_L$ of the head 200 is less than or equal to 60 mm. In another exemplary embodiment, the maximum longitudinal width $W_L$ of the head 200 is between 40 mm and 60 mm. In yet another embodiment, the maximum longitudinal width $W_L$ of the head 200 is between 40 mm and 55 mm. In a still further embodiment, the maximum longitudinal width $W_L$ of the head 200 is between 40-44 mm. In still another embodiment, the maximum longitudinal width $W_L$ of the head 200 is between 35 mm and 45 mm, more specifically between 35 mm and 40 mm, still more specifically between 37 mm and 39 mm, and even more specifically approximately 38.6 mm.

The head further comprises a maximum transverse width $W_T$, extending from a lead face 209 of the head 200 to a trail face 210 of the head 200. In an exemplary embodiment, the maximum transverse width $W_T$ of the head 200 is less than or equal to 25 mm. In another embodiment, the maximum transverse width $W_T$ of the head 200 is between 10 mm and 25 mm. In yet another embodiment, the maximum transverse width $W_T$ of the head 200 is between 10 mm and 20 mm. In still another embodiment, the maximum transverse width $W_T$ of the head 200 is between 10 mm and 16 mm. In a still further embodiment, the maximum transverse width $W_T$ of the head 200 is between 14 mm and 16 mm. In still other embodiments, the maximum transverse width $W_T$ of the head 200 may be between 6 mm and 10 mm, more specifically between 7 mm and 9 mm, more specifically between 8 mm and 9 mm, or approximately 8.3 mm.

In the exemplified embodiment, both the maximum longitudinal width $W_L$ of the head 200 and the maximum transverse width $W_T$ of the head 200 are measured on the front face 204 of the head 200. The front face 204 of the head 200 is the working face of the head 200 in that it is the face of the head 200 that is put into contact with the user's skin so that the shaving apparatus 1000 can shear hairs between the rotary cutter 300 and the fixed blade 350. In alternate embodiments, the maximum longitudinal width $W_L$ of the head 200 and/or the maximum transverse width $W_T$ of the head 200 may be dictated by other components of (or at other locations on) the head 200. In certain embodiments, a ratio of the longitudinal width $W_L$ of the head 200 to the transverse width $W_T$ of the head 200 is between 2.5 and 3.2, and more specifically the ratio can be between 2.7 and 3.0. In other embodiments, a ratio of the longitudinal width $W_L$ of the head 200 to the transverse width $W_T$ of the head 200 may be between 4.4 and 4.9, and more specifically between 4.6 and 4.7.

The tubular housing 202 is an elongated hollow tubular structure extending from a first end 212 of the tubular housing 202 to a second end 213 of the tubular housing 202 along longitudinal axis B-B. The tubular housing 202 comprises an internal cavity 211 for accommodating the rotary cutter 300 and the motor 400. The internal cavity 211 of the tubular housing 202 is dimensioned so as to be capable of receiving and enclosing both the rotary cutter 300 and the motor 400 therein.

The tubular housing 202 also comprises an elongated slot 214 that forms a passageway into the internal cavity 211 of the tubular housing 202. The elongated slot 214 allows hair bristles to enter the tubular housing 202 and be sheared between the rotary cutter 300 and the fixed blade 350 as discussed in greater detail with respect to FIGS. 5A-B. In the exemplified embodiment, the elongated slot 214 extends the entire longitudinal length of the tubular housing 202 in a continuous and uninterrupted manner. However, in certain alternate embodiments, the elongated slot 214 may not extend the entire longitudinal length of the tubular housing 202 and may instead be segmented and/or discontinuous in nature.

The elongated slot 214 is defined by a cutting edge 351 of the fixed blade 350 and an opposing edge 215 of the tubular housing 202. In the exemplified embodiment, the opposing edge 215 of the tubular housing is formed by a plurality of axially-spaced fingers 216 that collectively form a comb guard 217. The comb guard 217 is part of the tubular housing 202 and can be pressed against the user's skin during a cutting operation to more effectively feed the hair bristles to the rotary cutter 300 and fixed blade 350 for shearing, while at the same time protecting the user from nicking or cutting the skin. In order to further achieve this purpose, the outer surfaces 218 of the fingers 216 of the comb guard 217 are optionally flat or rounded to facilitate the movement of the head 200 over the user's skin.

In certain embodiments, the tubular housing 202 may also comprise an optional opening (short slot) in the rear face 203 of the head 200 for allowing removal of sheared hair bristle debris from the internal cavity 211. Such a feature may be especially useful in embodiments in which a bi-directional helical rotary cutter 300 is utilized (described in greater detail below). Finally, as can be seen in FIG. 3, the fastener elements 201 are also part of the tubular housing 202.

Figure 5A:
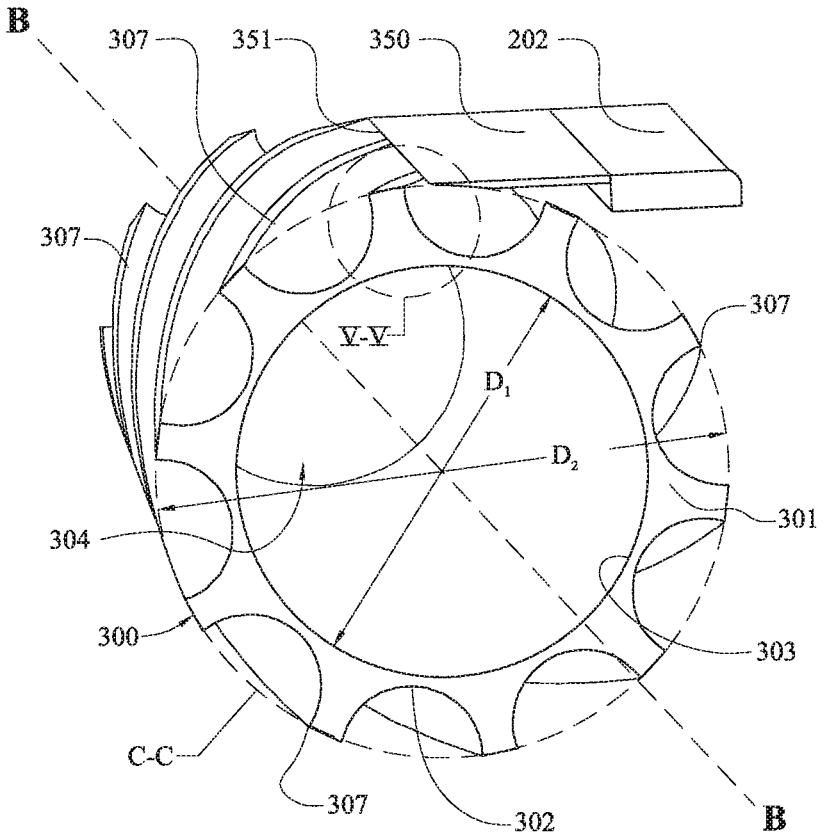
FIG. 5A is a schematic of the rotary cutter and fixed blade of the shaving apparatus head of FIG. 3 in which the rotary cutter and fixed blade are operably positioned to achieve the shearing of hairs therebetween in accordance with an embodiment of the present invention.
Figure 5B:
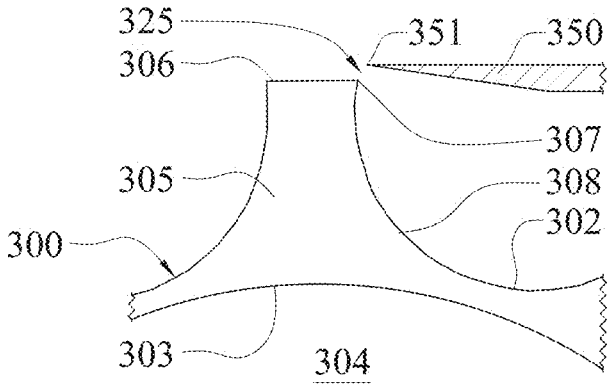
FIG. 5B is a close-up view of area V-V of FIG. 5A.

Referring now to FIGS. 4 and 5A-B, the rotary cutter 300 is of a hollow cylindrical configuration. Of course, the invention is not to be so limited in all embodiments and the rotary cutter 300 need not be hollow in all embodiments but may be solid in other embodiments. The rotary cutter 300 comprises a cylindrical body 301 having an outer surface 302 and an inner surface 303. The inner surface 303 forms a cavity 304 about the longitudinal axis B-B (which is also both the central axis and the rotational axis of the rotary cutter 300). In the exemplified embodiment, the cavity 304 of the rotary cutter 300 is dimensioned so as to receive the motor 400 therein. When the head 200 is assembled, the motor 400 is mounted within the cavity 304 of the rotary cutter 300 (discussed in detail with respect to FIG. 6). In an exemplary embodiment, the cavity 304 has a diameter $D_1$ between 3 mm to 18 mm. In another embodiment, the diameter $D_1$ of the cavity 304 is between 8 mm to 10 mm.

Of course, alternative embodiments are possible whereby the motor 400 is not positioned within the cavity 304 of the rotary cutter 300. For example, the rotary cutter 300 may be solid as noted above and thus not have a cavity for holding the motor 400. The rotary cutter 300 may also be hollow but still not retain the motor 400 therein. In such embodiments, the motor 400 may be located in the head 200 but not within the rotary cutter 300 (such as adjacent to the rotary cutter 300), or the motor 400 may be located within the handle 100 such as depicted schematically in FIG. 9 described briefly below.

The rotary cutter 300 further comprises a plurality of spaced-apart ridges 305 protruding from the outer surface 302 of the cylindrical body 301. The ridges 305 extend radially outward from the outer surface 302 of the cylindrical body 301 and terminate in convex outer surfaces 306 that collectively define a reference cylinder (delineated by dotted circle C-C of FIG. 5A) that is concentric to the longitudinal axis B-B and has a diameter $D_2$. In an exemplary embodiment, the diameter $D_2$ is less than or equal to 20 mm. In another embodiment, the diameter $D_2$ is between 6 mm to 20 mm. In yet another embodiment, the diameter $D_2$ is between 12 mm to 14 mm. In certain embodiments, a ratio of the longitudinal width $W_L$ of the head 200 to the diameter $D_2$ of the reference cylinder C-C is between 2.8 and 3.7, and more specifically the ratio is between 3.1 and 3.4. Furthermore, in some embodiments a ratio of the transverse width $W_T$ of the head 200 to the diameter $D_2$ of the reference cylinder C-C is between 1.0 and 1.35, and more specifically the ratio is between 1.1 and 1.25.

Each of the ridges 305 includes a sharpened cutting edge 307. In the exemplified embodiment, each of the cutting edges 307 is formed by the sharp intersection of the convex outer surfaces 306 of the ridges 305 and concave sidewall surfaces 308 of the ridges 305. As a result of the aforementioned structure, the rotary cutter 300 comprises a plurality of spaced-apart cutting edges 307 extending from the outer surface 302 of the cylindrical body 301.

In the exemplified embodiment, the spaced-apart ridges 305 (and thus the spaced-apart cutting edges 307) are in a helical configuration about the cylindrical body 301. In an alternative embodiment, the spaced-apart ridges 305 (and thus the spaced-apart cutting edges 307) can have a helical configuration twisted in one direction (hand) from a first end 309 of the rotary cutter 300 to a mid-point of the rotary cutter 300, and then twisted in the opposite direction (opposite hand) from that mid-point of the rotary cutter 300 to the second end 310 of the rotary cutter 300. Such a bi-directional helical rotary cutter 300 may be used to impel the hair bristle debris to a mid-point along the head 200 or away therefrom, thereby facilitating removal of the debris.

In further embodiments, the rotary cutter 300 can be of a segmental configuration, namely the rotary cutter 300 can be collectively formed by a plurality of cylindrical segments, or hollow cylinder slices, wherein each segment is formed with a plurality of evenly-spaced, outwardly-projecting ribs 305 and cutting edges 306 on its outer surface, and each slice is shifted by a small angle with respect to its adjacent neighboring slice. In an even further embodiment, the rotary cutter 300 can be (or form part of) the outer housing of the motor 400, which also acts as the rotor component of the motor while the stator of the motor 400 would be the core.

Referring now to FIGS. 3 and 5A-B, when the head 200 is assembled for operation, the fixed blade 350 is mounted adjacent the rotary cutter 300. In one embodiment, the fixed blade 350 is mounted adjacent the rotary cutter 300 so that the cutting edge 351 of the fixed blade 350 extends substantially parallel to the axis of rotation of the rotary cutter 300, which in the exemplified embodiment is the longitudinal axis B-B. In the exemplified embodiment, such adjacent positioning is achieved by mounting the fixed blade 350 to the tubular housing 202 so that the cutting edge 351 of the fixed blade 350 extends into the slot 314 and adjacent the cutting edges 307 of the rotary cutter 300.

In one embodiment, the fixed blade 350 is "fixed" with respect to its radial distance from the axis of rotation B-B of the rotary cutter 300. As used herein, the term "fixed" is intended to cover embodiments where small vibrations may be imparted to the fixed blade 350 and/or wherein the fixed blade 350 may axially translate slightly in a manner that maintains the cutting edge 351 substantially parallel to axis of rotation B-B and its radial distance therefrom. In certain other embodiments, the fixed blade 350 may be completely stationary and immovable with respect to both the axis of rotation B-B and the tubular housing 202.

When the exemplified embodiment is assembled, the cutting edge 351 of the fixed blade 350 extends along the entire length of the rotary cutter 300. The cutting edge 351 of the fixed blade 350 is sufficiently proximate the cutting edges 307 of the rotary cutter 300 so as to be effective in cooperating with the cutting edges 307 of the rotary cutter 300 to shear hair bristles therebetween during a cutting operation when the motor 400 is activated and the front face 204 of the head 200 is pressed against and moved along the skin. In one embodiment, a tolerance, in the form of a cutting gap 325 is designed to exist between the cutting edge 351 of the fixed blade 350 and the cutting edges 307 of the rotary cutter 300 during a cutting operation. In one embodiment, the cutting gap 325 is no greater than 0.5 mm, and optionally no greater than 2.5 mm. In one embodiment, the cutting gap 325 has a fixed size and thus can not be varied and/or adjusted. As shown in FIG. 5B, the cutting edges 307 of the rotary cutter 300 oppose the cutting edge 351 of the fixed blade 350 during shearing of the user's hair between the cutting edge 351 of the fixed blade 351 and the cutting edges 307 of the rotary cutter 300.

Figure 6:
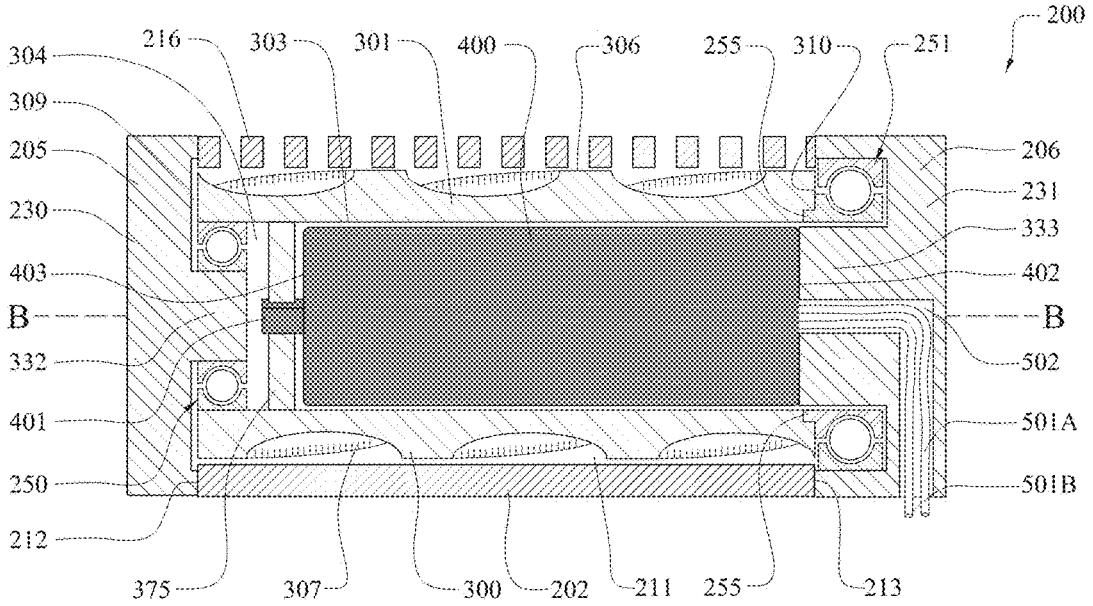
FIG. 6 is a cross-sectional view of the shaving apparatus head of FIG. 3 taken along the axis B-B.

Referring now to FIGS. 3-4 and 6, the structural cooperation of the various components of the head 200 in the assembled state will be further discussed. In the exemplified embodiment, when the head 200 is assembled for use, the motor 400 is positioned in the cavity 304 of the rotary cutter 300 and operably coupled thereto so as to be capable of rotating the rotary cutter 300 about the longitudinal axis B-B.

According to some embodiments of the present invention, the motor 400 is an electric motor and is electrically coupled to the power source 105 housed in the handle 100 as described below. When the motor 400 is electric, the motor 400 can be powered by alternating or direct current. In certain embodiments, the motor 400 may be a brushless type motor or a brushed motor type; and/or may be a cored or coreless type motor. For example, a brushless DC electric motor is a synchronous electric motor which is powered by direct-current electricity and has an electronically controlled commutation system (a "controller") instead of a mechanical commutation system based on brushes, as present in the brushed motors.

The motor 400 is dimensioned so as to be locatable within the cavity 304 of the rotary cutter 300. In one embodiment, the motor 400 has an outer diameter that is equal to or less than 12 mm. In another embodiment, the motor 400 has an outer diameter between 3 mm to 12 mm. In yet another embodiment, the motor 400 has an outer diameter between 3 mm to 10 mm. In a yet further embodiments, the motor 400 has an outer diameter between 3 mm to 8 mm.

It is noted herein that the term "motor," which is used herein interchangeably with the phrase "electric motor assembly," is intended to encompass the assembly of parts which transform electrical power to mechanical motion as a required output force/torque and speed. Adjustment of torque and speed is typically achieved by including a gear and/or another form of transmission element in the electric motor assembly.

As discussed hereinabove, the size of motor 400 is selected such that it can rotate the rotary cutter 300 at a sufficient torque and speed so as to effect shaving, considering the minimal contact between rotary cutter 300 and the user's skin, and considering the force required to cut more than one hair simultaneously. Since motor performance correlates to the size of the motor 400, the size limitation of the motor 400 can be derived from the following considerations: (i) the need for a compact minimal motor size which projects on the width of the shaving head and the size requirements of the power source (battery); and (ii) the need for sufficient torque and speed to accomplish fast and efficient shearing of more than one hair strand at the same time.

The assembly of the rotary cutter 300 and the motor 400 is, in turn, located within the internal cavity 211 of the tubular housing 202. The first end cap 205 is coupled to the first end 212 of the tubular housing 202. The first end cap 205 encloses a first end of the internal cavity 211 of the tubular housing 202 and a first end of the cavity 304 of the rotary cutter 300. Similarly, the second end cap 206 is coupled to the second end 213 of the tubular housing 202. The second end cap 206 encloses a second end of the internal cavity 211 of the tubular housing 202 and a second end of the cavity 304 of the rotary cutter 300. The first end cap 205 forms a first transverse wall 230 at the first end 212 of the tubular housing 202 while the second end cap 206 forms a second transverse wall 231 at the second end 213 of the tubular housing 202. These transverse walls 230, 231 assist in sealing the cavity 304 of the rotary cutter 300 from the ingress of water and other liquids that may damage the motor 400 and electrical connectors 501A, 501B. Of course, in certain alternate embodiments, the transverse end walls 230, 231 do not have to be formed by cap-like components but can be integrally formed as part of the tubular housing 202 or be mere plates or blocks extending from the handle 100. Furthermore, while the transverse walls 230, 231 are exemplified as flat plate-like structures, in alternate embodiments, the transverse walls 230, 231 can take the form of posts, blocks, struts and/or combinations thereof, and can also be contoured and/or inclined as desired.

Each of the transverse walls 230, 231 (or end caps 205, 206) comprise an inwardly extending axial posts 332, 333. The first annular bearing 250 is mounted to the first axial post 332 while the second annular bearing 251 is mounted to the second axial post 333. In the exemplified embodiment, both of the annular bearings 250, 252 are of the ball-bearing type. However, bearing types that can be used in the context of the present invention include, without limitation, plain bearings, also known as sliding or slipping bearings which are based on rubbing surfaces and typically a lubricant (implemented by use of hard metals or plastics such as PTFE which has coefficient of friction of about 0.05); rolling element bearing, also known as ball bearings which are based on balls or rollers (cylinders) and restriction rings; or magnetic bearings and flexure bearings. In certain embodiments, the annular bearings 250, 251 could take the form of the outer annular surfaces of the axial posts 332, 333, so long as these outer annular surfaces have been designed to achieve a desired coefficient of friction with the moving part in contact therewith. In certain alternate embodiments, at least one of the bearings may not be annular in nature. Finally, the term "annular" may include segmentally annular in certain embodiments.

Figure 7:
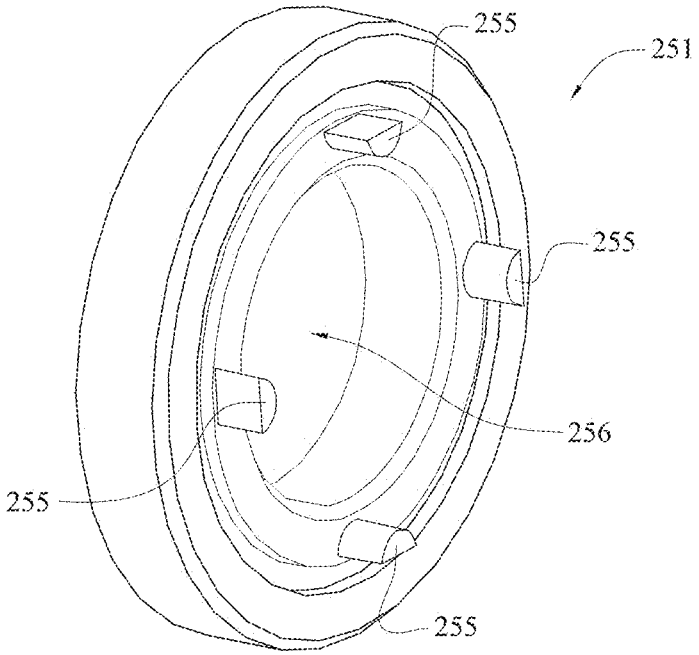
FIG. 7 is a perspective view of one embodiment of a bearing that can be used to rotatably mount the rotary cutter within the shaving apparatus head of FIG. 3.

The first annular bearing 250 rotatably mounts the first end 309 of the rotary cutter 300 to the first transverse wall 230 while the second annular bearing 251 rotatably mounts the second end 310 of the rotary cutter 300 to the second transverse wall 231. The first annular bearing 250 nests within the cavity 304 of the rotary cutter 300 and is coupled to the first end 309 of the rotary cutter 300 via contact/engagement with the inner surface 303 of the rotary cutter 300. The second annular bearing 251, however, abuts the second end 310 of the rotary cutter 300 and is coupled to the second end 310 of the rotary cutter 300 via bearing posts 255 (best shown in FIG. 7). Because the second annular bearing 251 is not positioned within the cavity 304 of the rotary cutter 300, it has a larger central opening 256 than the central opening (not numbered) of the first annular bearing 250. More specifically, the central opening 256 of the second annular bearing 251 has a transverse cross-sectional area that is greater than the transverse cross-sectional area of the central opening of the first annular bearing 250. This, in turn, allows the second axial post 333 to have a larger transverse cross-sectional area (when compared to the transverse cross-sectional area of the first axial post 332). In certain embodiments, this is beneficial because the increased transverse cross-sectional area of the second axial post 333 allows the second axial post 333 to maintain its strength and structural integrity despite having a channel 502 formed therein through which the electrical connectors 501A, 501B axially extend.

In one embodiment, the motor 400 is mounted within the cavity 304 of the rotary cutter 300. In the exemplified embodiment, the motor 400 is mounted to the second transverse wall 231 in a cantilevered manner. More specifically, a first end 402 of the motor 400 is mounted to the second transverse wall 231 while a drive shaft 401 extends from a second end 403 of the motor 400. The drive shaft 401 non-rotatably mates with an internal shaft-engagement element 375, which is in the form of a transverse wall that is non-rotatably coupled to the cylindrical body 301 of the rotary cutter 300. It will thus be seen that the rotary cutter 300 is driven by the motor 400 via the mating between the internal shaft-engagement piece 375 and the drive shaft 401, and is mounted by the annular bearings 250, 251 at its ends 309, 310, thereby providing a balanced coupling of the rotary cutter 300 to the motor 30 and the rotary cutter 300 within the tubular housing 202.

As mentioned above, the motor 400 is electrically powered by the power source 105 in the handle 100. The motor 400 is electrically coupled to the power source 105 by electrical connectors 501A, 501B which, in the exemplified embodiment are wires. In alternate embodiments, the electrical connectors take on other forms, including plating of surfaces with electrically conductive materials. The electrical connectors 501A, 501B are operably coupled to the motor 400 at one end and extend axially from the motor 400 through the second annular bearing 251 via the channel 502. Once through the annular bearing 251, the electrical connectors 501A, 501B extend radially away from the longitudinal axis B-B and into the handle 100 via the most desirable path selected.

Although not required in all embodiments, there are clear advantages in having the entire driving mechanism housed within the head 200, including a compact design and the locating of all of the motorized moving parts within the head 200. Such a design also eliminates the need to house the motor 400 or parts of the drive transmission mechanism in a separate housing. Such design further enables substantially quiet and substantially vibration free operation due to the central and coaxial position of the motor and rotor. Further, a minimal number of moving parts is required, which in turn contributes to the minimization of energy loss due to friction, slack and slippage, thereby substantially decreasing the noise and vibrations, as well as the wear and tear plaguing many of the presently known drive transmission mechanisms.

Another advantage afforded by the concept of the internally motorized head 200 presented herein, is the ability to arrive at very high speeds of rotation of the rotary cutter unit, driven by an internal driving mechanism. Hence, the scissors-like cutting action (energy-efficient cutting mechanism) coupled with an internally motorized shaving head affords the use of relatively small, low-energy and high-speed electric motors. Of course, as noted above and described below with reference to FIG. 9, the invention is not to be limited to one in which the motor is housed within the head and the motor may be located in the handle or otherwise as described herein.

The internally motorized shaving head can be constructed with an internal driving mechanism having a capacity to rotate the rotary cutter unit at a speed of at least 300 revolutions per minute (rmp). Alternatively, the rotational speed of the rotary cutter unit may be at least 500 rpm, 800 rpm, 1000 rpm, 1500 rpm, 2000 rpm, 3000 rpm, 4000 rpm, 5000 rpm, 7000 rpm, 10000 rpm, 12000 rpm, 15000 rpm, 20000 rpm, 25000 rpm, 30000 rpm, 40000 rpm and 50000 rpm. In one embodiment, the rotational speed of the rotary cutter unit is between 500 rpm and 2000 rpm. As should be appreciated from the discussion below, the rotational speed of the rotary cutter is dictated in part by the radius of the reference cylinder C-C of the rotary cutter. Thus, a rotary cutter with a larger radius may have a lower rotational speed than a rotary cutter with a smaller radius, while still having the same tangential velocity.

The optimal speed of rotation is effected by several factors, including the choice of electric motor, the current and voltage supplied to the electric motor, and optionally by use of an inline drive transmission, namely a particular assembly of gears, pins and the like, normally used to reduce or increase the output speed of a motor. Thus, the electric motor assembly may include an inline transmission device to control the output speed and torque of the electric motor in the internally motorized shaving head presented herein. As used herein, the phrase "inline transmission device" refers to a drive transmission device, or gear box, which is placed inline with the motor, namely the motor output shaft and the gearbox output shaft share the same axis of rotation. An inline transmission device may include epicyclic gearing, planetary gearing, or the like. Such an inline gearing system can be selected so as to increase the torque of the motor and reduce its speed or the opposite, depending on the selected motor and desired terminal rotation output. It is to be understood that various parts of the internally motorized shaving head presented herein are presented as discrete and separate parts for the sake of clarity and definition. However, some of the parts described herein can be manufactured as a union with other parts, forming a single continuous unit, while some parts described herein as single continuous units can be formed by a plurality of sub-parts.

Figure 8:
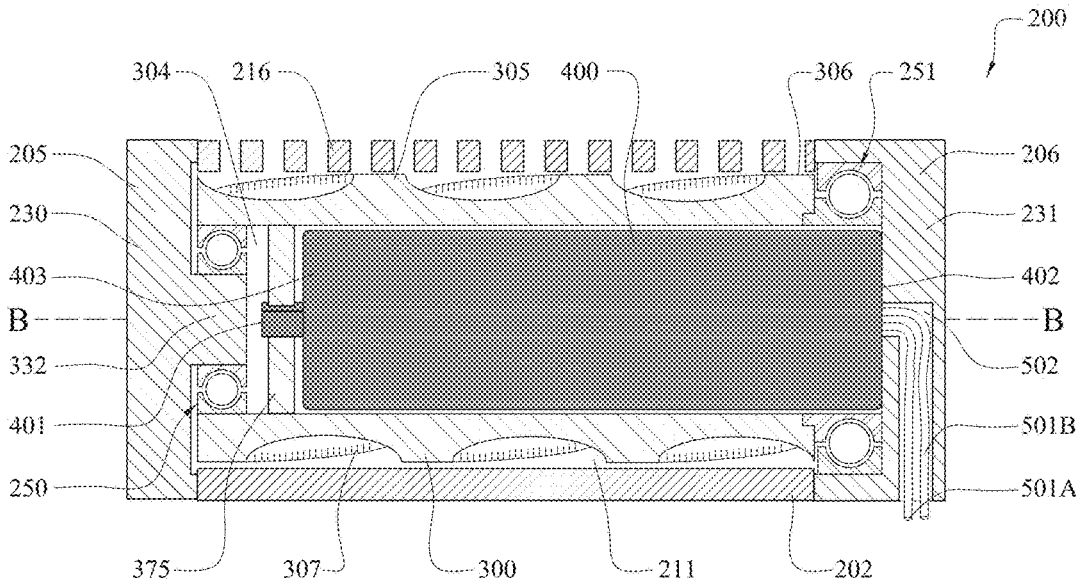
FIG. 8 is a cross-sectional view of a shaving apparatus head in accordance with an alternate embodiment of the present invention, wherein the motor extends through one of the annular bearings.

Referring now to FIG. 8, an alternate embodiment of the head 200 is exemplified. In this alternate embodiment, a portion of the motor 400 extends through the second annular bearing 251 rather than the electrical connectors 501A, 501B. Moreover, the second annular bearing 251 is mounted to the motor 400 while the second axial post 333 is omitted.

The shaving apparatus, according to some embodiments of the present invention, equipped with the shaving head according to some embodiments presented herein, can be used to effect close shave of hair bristles, such as human facial hair, rapidly and safely.

Unlike traditional manual or mechanized scrapers, the shaving apparatus presented herein can be used with or without lubrication or wetting of the skin prior to or during the shaving process. Hence, since the shaving apparatus presented herein is based on scissors-action rather than pure scraping, the apparatus can be used effectively under wet or dry conditions substantially without requiring pretreatment or conditioning of the hair or skin. The phrase "pretreatment or conditioning of the hair or skin," as used herein, refers to any form of wetting the skin/hair by the application of water, a pre-shaving composition, a lotion and/or foam. It is noted herein that pretreatment or conditioning of the hair or skin is not a prerequisite but an option of the shaving process using the shaving apparatus presented herein.

One exemplary mode of use of the shaving apparatus presented herein starts with a user gripping the apparatus at handle 100, and switching switch 108 thereby turning the apparatus to the operational ("on") state, which means that rotary cutter 300 of the head 200 is rotating as a result of the rotation of motor 400, which is powered by power source 105. Once the apparatus is operational, the user presses front face 104 of the shaving head 200 flat on his/her skin, and glides the head 200 across the skin at a direction which is generally perpendicular to the longitudinal axis B-B. The direction of motion can be a forward or a backward motion. However, hair is shaved (or trimmed) essentially without movement of the head 200 with respect to the skin's surface as hair shearing occurs as a result of the relative motion between the cutting edges 307 of the rotary cutter 300 and the fixed blade 351, and regardless of the relative motion of the head 200 to the user's skin. It is noted herein that the shaving process using the shaving apparatus presented herein can be carried out by lifting and re-contacting the head 200 with the surface of the skin. However, in certain embodiments, the head 200 is moved by the user across the skin's surface while the head 200 is pressed against the surface of the skin so as to effect shaving at other areas of the skin surface in a continuous manner.

The shaving head presented herein can also effect hair cutting at any distance from the skin (where the hair follicle is found), leaving trimmed hair. This hair trimming can be achieved by adding an extension to the shaving head or building in a desired tolerance/gap, allowing the front face 204 of the head 200 to be placed on the hair growing surface at a pre-determined distance which corresponds to the length of the trimmed hair.

During shaving, the working surface of the shaving apparatus 1000 is placed against a surface to be shaved, such as a user's face, arms, legs, chest, back, or the like. The working surface of the shaving apparatus 1000 is then moved along the surface to be shaved at a linear velocity, which is the speed at which the user's hand moves during shaving. The linear velocity varies during the shaving operation and between users and may be less than 10 mm/sec, or it may be 20 mm/sec, 30 mm/sec, 50 mm/sec, 100 mm/sec, 150 mm/sec, 200 mm/sec, 300 mm/sec or any number therebetween. For example, a user may shave with a linear velocity of 10 mm/sec during the beginning of the shaving operation when the hairs are longer and may shave with a linear velocity of 100 mm/sec during the end of the shaving operation when the hairs may be shorter due to having already been trimmed by the shaving apparatus 1000. Thus, there is no set linear velocity that a given user shaves with and this varies during the shaving operation and between users.

Furthermore, during shaving the rotary cutter 300 rotates within the head 200 at a particular rotational speed or at a particular number of revolutions per minute (RPMs). Furthermore, the RPMs of the particular rotary cutter 300 translate into a particular tangential velocity Vt. Specifically, the tangential velocity $Vt=(RPM*2*\Pi*r)/60$, where RPM is the number of revolutions per minute at which the rotary cutter 300 is rotating and r is the radius of the rotary cutter 300 (or the radius of the reference cylinder C-C defined by the cutting edges of the rotary cutter 300).

In certain embodiments, in order for acceptable shearing to occur, the tangential velocity Vt of the rotary cutter 300 must be equal to or greater than the linear velocity at which the working surface is moving across the surface being shaved. Otherwise, effective shearing/shaving may not occur and the hair being sheared might be pinched and pulled as it is being sheared, which is painful and can cause irritations. In some embodiments, in order to achieve pain free and effective shearing, the tangential velocity Vt of the rotary cutter 300 must be greater than, and in some embodiments significantly greater than, the linear velocity at which the working surface is moved across the surface being shaved. Significantly greater can be a tangential velocity Vt that is at least 20, or at least 30, or at least 50, or at least 100, or at least 200 mm/sec greater than the linear velocity. In other embodiments, significantly greater can be a tangential velocity Vt that is at least 1.1, at least 1.2, at least 1.3, at least 1.4, at least 1.5, at least 1.6, at least 1.7, at least 1.8, at least 1.9, or at least 2.0 times the linear velocity. This can be difficult to ensure due to the variation in the linear velocity at which a given user shaves as discussed above.

Thus, if the linear velocity is 300 mm/sec, the tangential velocity Vt must be greater than 300 mm/sec. If the radius of the rotary cutter 300 (or the reference cylinder C-C thereof) is 3 mm, the rotary cutter 300 must rotate at at least 950 RPM to have a tangential velocity Vt of 300 mm/sec. If the radius of the rotary cutter 300 (or the reference cylinder C-C thereof) is 4 mm, the rotary cutter 300 must rotate at at least 700 RPM to have a tangential velocity Vt of 300 mm/sec. If the radius of the rotary cutter 300 (or the reference cylinder C-C thereof) is 5 mm, the rotary cutter 300 must rotate at at least 550 RPM to have a tangential velocity of 300 mm/sec. An exemplary table is provided below to illustrate the different RPM values needed to achieve a desired tangential velocity (or tangential speed) based on a given radius of the rotary cutter:

| | | Tangential speed [mm/sec] | | | |
|---|---|---|---|---|---|
| RPM | | 200 | 300 | 400 | 500 |
| Radius [mm] | 3 | 637 | 955 | 1273 | 1592 |
| | 4 | 477 | 716 | 955 | 1194 |
| | 5 | 382 | 573 | 764 | 955 |

Of course, the exact tangential velocity Vt needed for effective and pain free shearing is dictated by the linear velocity of the user's hand during shaving. Thus, if a user moves his/her hand slower during shaving, a lower tangential velocity Vt may be possible. However, studies have shown that a standard maximum linear velocity of a user's hand during shaving is approximately 300 mm/sec, although it is typically less than that. Thus, in order to ensure that the tangential velocity Vt of the rotary cutter 300 is equal to or greater than the linear velocity of the user's hand during shaving, it is preferred in some embodiments that the tangential velocity Vt of the rotary cutter is at least 300 mm/sec.

Figure 9:
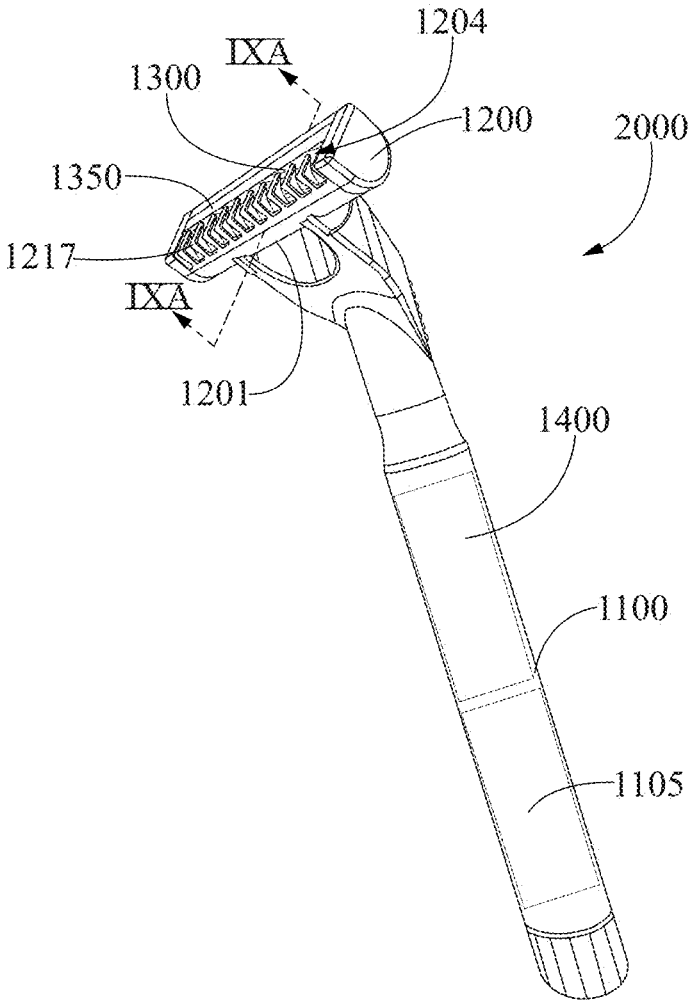
FIG. 9 is a front perspective view of a shaving apparatus in accordance with an alternative embodiment of the present invention.
Figure 10:
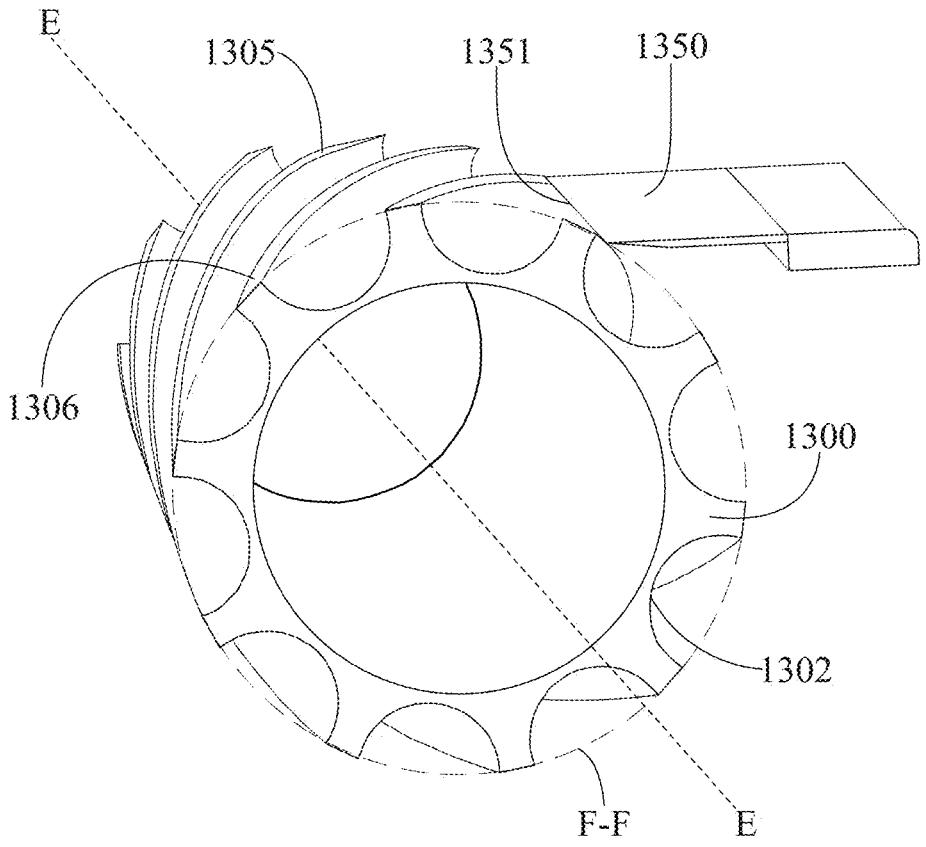
FIGS. 10 and 11 are schematic illustrations of the rotary cutter and the fixed blade of the shaving apparatus of FIG. 9 in which the rotary cutter and the fixed blade are operably positioned to achieve the shearing of hairs therebetween in accordance with an embodiment of the present invention.
Figure 11:
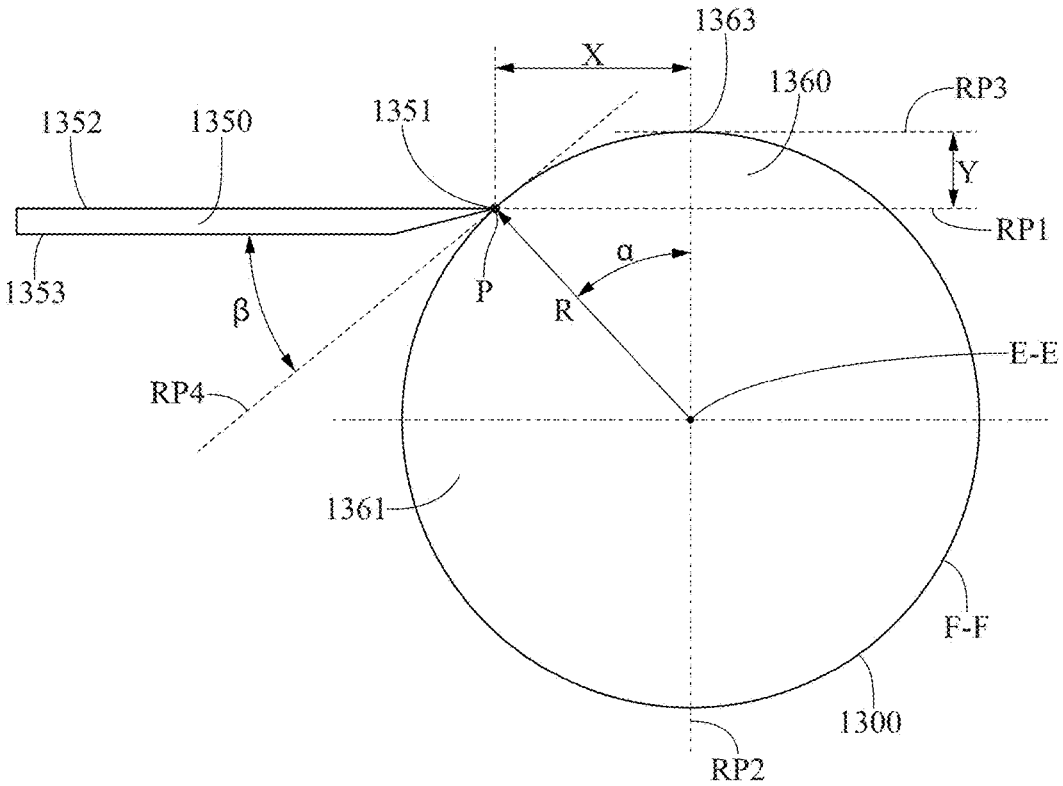

Referring to FIGS. 9-11, another embodiment of a shaving apparatus 2000 will be described in accordance with the present invention. Many features and components of the shaving apparatus 2000 are identical to components of the shaving apparatus 1000 already described herein above. Thus, for those features and components a detailed description will not be repeated herein, it being understood that the description of those features above with regard to the shaving apparatus 1000 is applicable.

The shaving apparatus 2000 generally comprises a handle 1100 and a head 1200. The handle 1100 and the head 1200 are quite similar to the handle 100 and the head 200 of the shaving apparatus 1000 described above. In certain embodiments, the invention is directed to the head 1200 and its components by itself. For example, the head 1200 could be a replaceable head in some embodiments that can be attached to and detached from the handle 1100.

The head 1200 comprises a body that extends from a bottom end 1201 to a working surface 1204 along an axis D-D. The working surface 1204 is the surface of the body that comes into contact with a user's skin during shaving. Stated another way, the working surface 1204 is the exposed surface of the body. Furthermore, the head 1200 comprises a fixed blade 1350 having a cutting edge 1351 and a rotary cutter 1300 that is disposed within the head 1200 similar to that which has been described previously. Stated another way, the rotary cutter 1300 and the fixed blade 1350 are each mounted to the body of the head 1200. The rotary cutter 1300 is caused to rotate about a rotational axis E-E due to coupling between the rotary cutter 1300 and a motor 1400. Furthermore, the motor 1400 is powered by a power source 1105 such as a battery or the like as described above. During operation, a user's hairs are sheared between cutting edges 1306 of the rotary cutter 1300 and the cutting edge 1351 of the fixed blade 1350 when the rotary cutter 1300 is rotating.

One of the differences in this embodiment relative to the embodiment which was previously described is that the motor 1400 of the shaving apparatus 2000 is located in the handle 1200 rather than in the head 1100. Thus, the motor 1400 may be operably coupled to the rotary cutter 1300 via gears, shafts, belts, or the like rather than positioning the motor 1400 within the rotary cutter 1300. The motor 1400 is still operably coupled to the rotary cutter 1300 to cause the rotary cutter 1300 to rotate about the rotational axis E-E. The motor 1400 may be located in the handle 1100 as shown in this embodiment, in the head 1200 within the rotary cutter 1300 as shown in the previous embodiment, or elsewhere as would be understood by persons skilled in the art (such as in the head 1200 but not within the rotary cutter 1300).

Referring to FIG. 10, the rotary cutter 1300 and the fixed blade 1350 are illustrated removed from the shaving apparatus 2000. In the exemplified embodiment, the rotary cutter 1300 comprises a plurality of spaced-apart ridges 1305 protruding from its outer surface 1302. The terminal ends of the spaced-apart ridges 1305 form cutting edges 1306 of the rotary cutter 1300. When the rotary cutter 1300 is rotated by the motor 1400 about the rotational axis E-E, the cutting edges 1306 come into contact with the cutting edge 1351 of the fixed blade 1350 to shear a user's hair.

Although the rotary cutter 1300 is illustrated having spaced-apart ridges 1305 extending from the outer surface 1302 that form the cutting edges 1306, this is not required in all embodiments. Specifically, in alternative embodiments the rotary cutter 1300 may have apertures or openings formed into the outer surface 1302, and the edges that bound the apertures may form the cutting edges. The edges bounding the apertures can be made very sharp to ensure that they facilitate effective and efficient shearing when the edges pass by the cutting edge 1351 of the fixed blade 1350 during rotation of the rotary cutter 1300 about the rotational axis E-E.

In the exemplified embodiment, the cutting edges 1306 of the rotary cutter 1300 collectively define a reference cylinder (delineated by dotted circle F-F in FIG. 10). In alternative embodiments such as that described above whereby the cutting edges are defined by edges that surround an aperture formed into the outer surface 1302 of the rotary cutter 1300, the outer surface 1302 of the rotary cutter 1300 itself may define the reference cylinder F-F (because there are no ridges extending from the outer surface 1302 of the rotary cutter 1300). However, even in this alternative embodiment it may be properly stated that the cutting edges define the reference cylinder F-F because the cutting edges are located directly on the outer surface of the rotary cutter. Basically, the outermost portion of the rotary cutter 1300, whether it is the outer surface 1302 of the rotary cutter 1300 main body or ridges extending therefrom, forms the reference cylinder F-F described herein.

The reference cylinder F-F is concentric to the rotational axis E-E and has a diameter that may be similar to the diameter $D_2$ discussed above. As seen in FIG. 10, the rotary cutter 1300 and the fixed blade 1350 are positioned adjacent to each other in a closely spaced relationship so that a user's hairs are sheared between the cutting edge 1351 of the fixed blade 1350 and the cutting edges 1306 of the rotary cutter 1300 when the rotary cutter 1300 is rotating about the rotational axis E-E. As will be discussed in greater detail below with reference to FIGS. 9A and 11, the fixed blade 1350 (and specifically the cutting edge 1351 thereof) is positioned below the apex 1363 of the reference cylinder F-F.

Figure 9A:
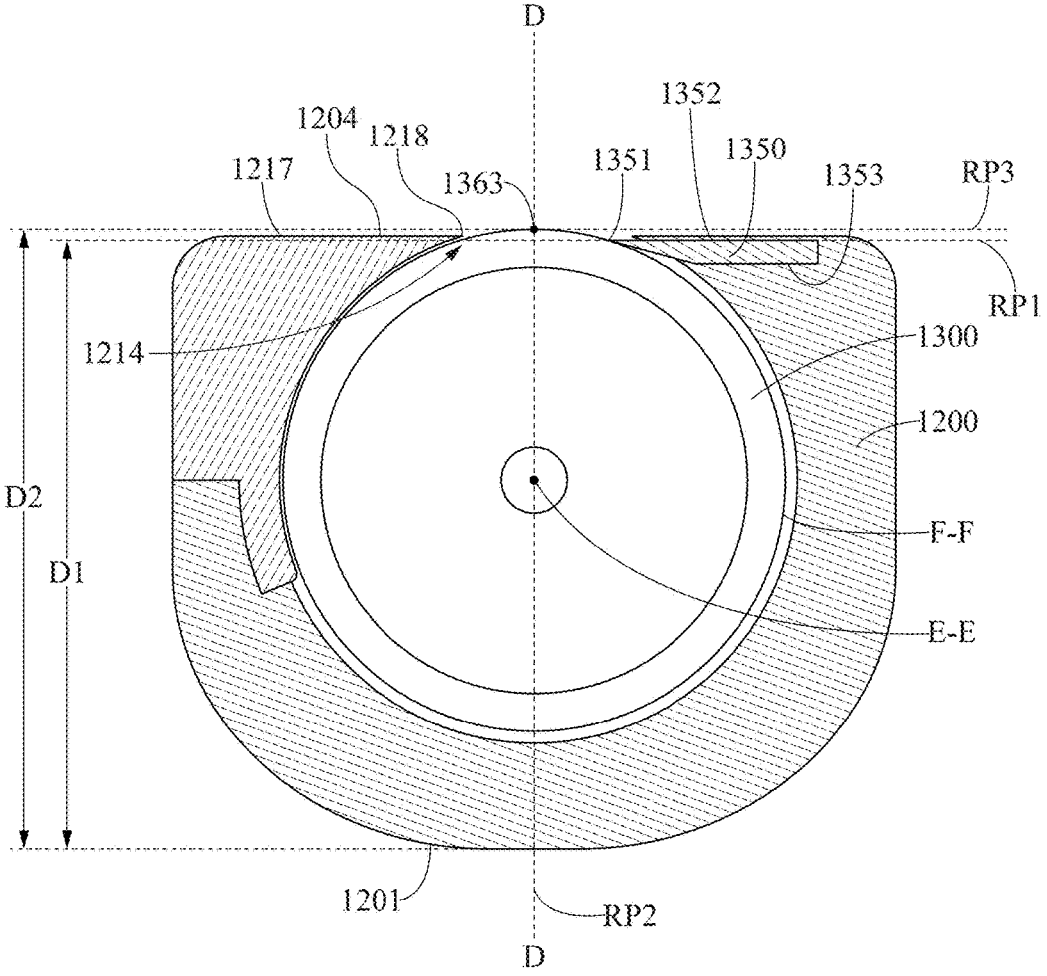
FIG. 9A is a schematic cross-sectional view taken along line IXA-IXA in FIG. 9 with the shaving apparatus head in an upright state.

Referring now to FIGS. 9A and 11 concurrently, the relative position between the fixed blade 1350 and the rotary cutter 1300 will be described in more detail. It should be appreciated that FIG. 9A is a schematic cross-sectional view through line IXA-IXA of FIG. 9 rather than an exact replication of that cross-sectional view. Specifically, in FIG. 9A the ridges 1305 and the cutting edges 1306 are not illustrated. Rather, in FIG. 9A the outer boundary of the rotary cutter 1300 is the reference cylinder F-F of the rotary cutter 300 that is formed collectively by the cutting edges thereof (the specific details of the cutting edges are simply omitted for clarity of understanding and so that the description is made with reference to the reference cylinder F-F rather than with reference to the cutting edges). Similarly, FIG. 11 illustrates schematically the reference cylinder F-F of the rotary cutter 1300 and the fixed blade 1350 to facilitate a discussion about their relative positions.

In this embodiment, the relative position of the fixed blade 1350 and the rotary cutter 1300 is different than in the previous embodiment. Specifically, in this embodiment the fixed blade 1350 has a top surface 1352 and an opposite bottom surface 1353. At least a portion of the top surface 1352 is exposed at the working surface 1204 of the body of the head 1200 in that it is visible to a user who is viewing the working surface 1204. The bottom surface 1353 is not exposed and is not visible to a user. The top surface 1352 of the fixed blade 1350 may contact a user's skin/surface to be shaved during use. As illustrated, the reference cylinder F-F defined by the cutting edges 1306 of the rotary cutter 1300 protrudes above the exposed top surface 1352 of the fixed blade 1350. As described herein, the fixed blade 1350 may be oriented at different angles and in some embodiments portions of the top surface 1352 of the fixed blade 1350 may be above the apex 1363 of the reference cylinder F-F and other portions of the top surface 1352 of the fixed blade 1350 may be below the apex 1363 of the reference cylinder F-F. In some embodiments, the reference cylinder F-F protrudes from at least a portion of the exposed top surface 1352 of the fixed blade 1350. Furthermore, in some embodiments the reference cylinder F-F protrudes from the portion of the top surface 1352 of the fixed blade 1350 that is directly adjacent to the cutting edge 1351 of the fixed blade 1350.

As will be discussed in more detail below, the fixed blade 1350 may not be oriented horizontally in all embodiments as it is in the exemplified embodiment. Specifically, the fixed blade 1350 may be oriented at various angles with the top surface 1352 angled downwardly from the cutting edge 1351 to the opposite end of the fixed blade 1350 or with the top surface 1352 angled upwardly from the cutting edge 1351 to the opposite end of the fixed blade 1350. Thus, for clarity of understanding, in certain embodiments the cutting edge 1351 of the fixed blade 1350 is located below the apex 1363 of the reference cylinder F-F. Stated another way, the reference cylinder F-F protrudes above or protrudes from the cutting edge 1351 of the fixed blade 1350.

The fixed blade 1350 extends along a first reference plane RP1. In the exemplified embodiment the top surface 1352 of the fixed blade 1350 lies on the first reference plane RP1. However, in other embodiments the first reference plane RP1 may pass through the center of the fixed blade 1350 between the top and bottom surfaces 1352, 1353 or the bottom surface 1353 of the fixed blade 1350 may lie on the first reference plane RP1.

In the exemplified embodiment, the first reference plane RP1 is a horizontal reference plane. This is achieved in the exemplified embodiment because the fixed blade 1350 is oriented horizontally. However, in other embodiments the fixed blade 1350 may not be oriented horizontally as described herein below. In some such embodiments the first fixed blade 1350 extends along the first reference plane RP1, and thus if the fixed blade 1350 is not horizontal neither will the first reference plane RP1. Regardless, the first reference plane RP1 may still intersect the reference cylinder F-F as described herein below. In other embodiments, even if the fixed blade 1350 is not horizontally oriented as described herein, the first reference plane RP1 may still be horizontal. Thus, as discussed in more detail below, in some embodiments the first reference plane RP1 is orthogonal/perpendicular to the axis D-D regardless of the particular orientation of the fixed blade 1350.

As noted above, in the exemplified embodiment the body of the head 1200 extends from the bottom end 1201 to the working surface 1204 along the axis D-D, and the axis D-D intersects (and is perpendicular to) the rotational axis E-E of the rotary cutter 1300. Furthermore, in the exemplified embodiment the first reference plane RP1 is orthogonal or perpendicular to the axis D-D.

Although the first reference plane RP1 is described above as being the plane that the fixed blade 1350 extends along, the invention is not to be so limited and the first reference plane RP1 may be defined differently in other embodiments. Specifically, in some embodiments the first reference plane RP1 is a plane upon which the cutting edge 1351 of the fixed blade 1350 lies and that is perpendicular to the axis D-D. Thus, in some embodiments regardless of the orientation of the fixed blade 1350, the first reference plane RP1 is perpendicular to the axis D-D.

In the exemplified embodiment, the first reference plane RP1 intersects the reference cylinder F-F of the rotary cutter 1300. Stated another way, the first reference plane RP1 is a secant of the reference cylinder F-F of the rotary cutter 1300. Thus, the first reference plane RP1 is non-tangential to the reference cylinder F-F of the rotary cutter 1300. The first reference plane RP1 divides the reference cylinder F-F into a first portion 1360 that is located on a first side of the reference plane RP1 and a second portion 1361 that is located on a second side of the reference plane RP1. Furthermore, the first portion 1360 of the reference cylinder F-F protrudes above the exposed top surface 1352 of the fixed blade 1350.

As with the previously described embodiment, the head 1200 has a comb 1217 and the fingers of the comb 1217 terminate at distal edges 1218. The head 1200 has an elongated slot 1214 formed between the cutting edge 1351 of the fixed blade 1350 and the distal edges 1218 of the fingers of the comb 1217. In the exemplified embodiment, the comb 1217 is illustrated having an upper surface that is parallel to the first reference plane RP1. However, this is not required and the comb 1217 may have an upper surface oriented at an oblique angle relative to the first reference plane RP1 in other embodiments. In alternate embodiments, the comb 1217 may be omitted and the elongated slot 1214 may be formed between the cutting edge 1351 of the fixed blade 1350 and an opposing edge of the head 1200. In the exemplified embodiment, the first portion 1360 of the reference cylinder F-F protrudes or extends into and through the elongated slot 1214.

A second reference plane RP2 that is orthogonal to the first reference plane RP1 extends through the rotary cutter 1300 and comprises the rotational axis E-E of the rotary cutter 1300. The reference cylinder F-F has an apex 1363 which, in the exemplified embodiment, is the portion of the first portion 1360 of the reference cylinder F-F that is intersected by the second reference plane RP2. Stated another way, the apex 1363 is the portion of the reference cylinder F-F that is located furthest, in the direction of the axis D-D, from the bottom end 1201 of the body of the head 1200. The cutting edge 1351 of the fixed blade 1350 and the first reference plane RP1 are located below the apex 1363 of the reference cylinder F-F. Stated another way, the cutting edge 1351 of the fixed blade 1350 and the first reference plane RP1 are located a first distance D1 from the bottom end 1201 of the body of the head 1200 measured along a reference line parallel to the axis D-D and the apex 1363 of the reference cylinder F-F is located a second distance D2 from the bottom end 1201 of the body of the head 1200 measured along a reference line parallel to the axis D-D, the second distance D2 being greater than the first distance D1.

The second reference plane RP2 intersects the first reference plane RP1 at a first intersection reference line. The second reference plane RP2 intersects the reference cylinder F-F at a second intersection reference line. In the exemplified embodiment, the first intersection reference line is spaced a first radial distance inward from the second intersection reference line. Specifically, the first intersection reference line is positioned radially closer to the rotational axis E-E than the second intersection reference line.

A third reference plane RP3 is tangent to the reference cylinder F-F at the apex 1363 of the reference cylinder 1363. The first reference plane RP1 is radially spaced apart from the third reference plane RP3 so that the first reference plane RP1 is radially closer to the rotational axis E-E than the third reference plane RP3. In the exemplified embodiment, the first reference plane RP1 is parallel to the third reference plane RP3.

The cutting edge 1351 of the fixed blade 1350 is located at a first distance X from the second reference plane RP2. Furthermore, the first reference plane RP1 (and specifically the cutting edge 1351 of the fixed blade 1350) is located at a second distance Y from the apex 1363 of the reference cylinder F-F (and hence also from the third reference plane RP3). In the exemplified embodiment, the first distance X is greater than the second distance Y. In certain embodiments, the first distance X is between 0.1 mm and 1.5 mm, and more specifically between 0.5 mm and 1.5 mm. Furthermore, in certain embodiments the second distance Y is between 0.01 mm and 0.3 mm.

The cutting edge 1351 of the fixed blade 1350 is in contact with (or adjacent to and very slightly spaced from) the reference cylinder F-F along a reference line P, and there is a fourth reference plane RP4 that is tangent to the reference cylinder at the reference line P. An angle β is formed between the bottom surface 1353 of the fixed blade 1350 and the fourth reference plane RP4. The angle β may be modified from the angle shown. Specifically, the angle β may be increased by rotating the fixed blade 1350 clockwise without moving the cutting edge 1351 (i.e., using the cutting edge 1351 as the rotational axis) and the angle β may be decreased by rotating the foxed blade counterclockwise without moving the cutting edge 1351 (i.e., using the cutting edge 1351 as the rotational axis).

Furthermore, an angle α is formed as shown. Specifically, the angle α is formed between the second reference plane RP2 and a radius of the reference cylinder F-F that intersects reference cylinder F-F at the line P or the cutting edge 1351 of the fixed blade 1350. In the exemplified embodiment, the angle α may be determined by the equation $\alpha=\mathrm{ArcSin}(X/R)$, wherein R is the radius of the reference cylinder F-F as shown in FIG. 11. Furthermore, in the exemplified embodiment, the second distance Y may be determined by the equation $Y=R\,(R^2-X^2)^{1/2}$. Exemplary values of X, α, R, and Y for various embodiments are provided in the table below:

| | R = 5 | | R = 4 | |
|---|---|---|---|---|
| X | α° | ΔY | α° | ΔY |
| 0.2 | 2.3 | 0.004 | 2.9 | 0.005 |
| 0.4 | 4.6 | 0.016 | 5.7 | 0.020 |
| 0.6 | 6.9 | 0.036 | 8.6 | 0.045 |
| 0.8 | 9.2 | 0.064 | 11.5 | 0.081 |
| 1 | 11.5 | 0.101 | 14.5 | 0.127 |
| 1.2 | 13.9 | 0.146 | 17.5 | 0.184 |
| 1.4 | 16.3 | 0.200 | 20.5 | 0.253 |
| 1.6 | 18.7 | 0.263 | 23.6 | 0.334 |
| 1.8 | 21.1 | 0.335 | 26.7 | 0.428 |
| 2 | 23.6 | 0.417 | 30.0 | 0.536 |
| 2.2 | 26.1 | 0.510 | 33.4 | 0.659 |
| 2.4 | 28.7 | 0.614 | 36.9 | 0.800 |
| 2.6 | 31.3 | 0.729 | 40.5 | 0.960 |
| 2.8 | 34.1 | 0.858 | 44.4 | 1.143 |
| 3 | 36.9 | 1.000 | 48.6 | 1.354 |

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A shaving apparatus head in an upright state comprising:

a body;

a rotary cutter mounted to the body so as to be rotatable about a rotational axis, the rotary cutter comprising cutting edges that collectively define a reference cylinder about the rotational axis; and a blade mounted to the body and having a top surface defining a first reference plane that intersects the reference cylinder and divides the reference cylinder into two portions that are located on opposite sides of the first reference plane, the blade positioned so that a user's hairs are sheared between a cutting edge of the blade and the cutting edges of the rotary cutter when the rotary cutter is rotating about the rotational axis.

2. The shaving apparatus head according to claim 1 wherein the body comprises a bottom end, a working surface, and a body axis that extends from the bottom end to the working surface, the body axis being orthogonal to the first reference plane.

3. The shaving apparatus head according to claim 1 wherein a second reference plane that is orthogonal to the first reference plane extends through the rotary cutter, the rotational axis of the rotary cutter lying in the second reference plane, the second reference plane intersecting the first reference plane at a first intersection reference line, the second reference plane intersecting a portion of the reference cylinder that is located furthest from a bottom end of the body at a second intersection reference line so that the first intersection reference line is located between the second intersection reference line and the rotational axis of the rotary cutter; and wherein the first intersection reference line is spaced from the second intersection reference line.

4. The shaving apparatus head according to claim 3 wherein the portion of the reference cylinder protrudes beyond the top surface of the blade and is spaced apart from the first reference plane by a distance of between 0.01 mm and 0.3 mm measured along the second reference plane.

5. The shaving apparatus head according to claim 1 wherein the blade is immovable with respect to the rotational axis of the rotary cutter.

6. The shaving apparatus head according to claim 1 wherein the first reference plane forms a secant of the reference cylinder.

7. The shaving apparatus head according to claim 1 wherein the first reference plane is non-tangential to the reference cylinder.

8. The shaving apparatus head according to claim 1 wherein the body comprises a comb and an elongated slot defined between the cutting edge of the blade and the comb, and wherein the first reference plane intersects a portion of the reference cylinder that extends through the elongated slot.

9. The shaving apparatus head according to claim 8 wherein at least a portion of the top surface of the blade is exposed and the blade has a bottom surface opposite the top surface, and wherein the portion of the reference cylinder that extends through the elongated slot protrudes above the exposed portion of the top surface of the blade.

10. A shaving apparatus head in an upright state comprising:

a body;

a blade mounted to the body, the blade having a top surface that lies in defines a first reference plane and an opposite bottom surface;

a rotary cutter mounted to the body so as to be rotatable about a rotational axis, the rotary cutter comprising cutting edges that collectively define a reference cylinder about the rotational axis, a first portion of the reference cylinder being located on a first side of the first reference plane and a second portion of the reference cylinder being located on a second side of the first reference plane; and wherein the cutting edges of the rotary cutter are positioned adjacent a cutting edge of the blade so that a user's hairs are sheared between the cutting edge of the blade and the cutting edges of the rotary cutter when the rotary cutter is rotating about the rotational axis.

11. The shaving apparatus head according to claim 10 wherein the body comprises a bottom end, a working surface, and a body axis that extends from the bottom end to the working surface, the body axis being orthogonal to first reference plane.

12. The shaving apparatus head according to claim 10 wherein the first reference plane forms a secant of the reference cylinder.

13. The shaving apparatus head according to claim 10 wherein the first reference plane is non-tangential to the reference cylinder.

14. The shaving apparatus head according to claim 10 wherein the body comprises a comb and an elongated slot defined between the cutting edge of the blade and the comb, and wherein the first reference plane intersects a portion of the reference cylinder that is located within the elongated slot.

15. The shaving apparatus head according to claim 10 wherein a second reference plane that is orthogonal to the first reference plane extends through the rotary cutter, the rotational axis of the rotary cutter lying in the second reference plane, wherein the cutting edge of the blade is spaced apart from the second reference plane by a first distance measured along the first reference plane, and wherein a portion of the reference cylinder that is located furthest from a bottom end of the body is spaced apart from the first reference plane by a second distance measured along the second reference plane, the first distance being greater than the second distance.

16. A shaving apparatus head in an upright state comprising:

a body comprising a bottom end, a working surface, and a body axis that extends from the bottom end to the working surface;

a rotary cutter mounted to the body so as to be rotatable about a rotational axis, the rotary cutter comprising cutting edges that collectively define a reference cylinder about the rotational axis;

a blade mounted to the body, the blade comprising a top surface and a cutting edge that define a first reference plane that is orthogonal to the body axis, wherein a first portion of the reference cylinder is located on a first side of the reference plane and a second portion of the reference cylinder is located on a second side of the reference plane; and wherein the cutting edges of the rotary cutter are positioned adjacent the cutting edge of the blade so that a user's hairs are sheared between the cutting edge of the blade and the cutting edges of the rotary cutter when the rotary cutter is rotating.

17. The shaving apparatus head according to claim 16 wherein the body comprises an elongated slot in the working surface formed between the cutting edge of the blade and an edge of the head that opposes the cutting edge of the blade, wherein the second portion of the reference cylinder protrudes through the elongated slot, and wherein the body axis intersects the elongated slot.

18. The shaving apparatus head according to claim 16 wherein a second reference plane that is orthogonal to the first reference plane extends through the rotary cutter, the rotational axis of the rotary cutter and the body axis lying in the second reference plane.

* * * * *